US007146309B1

(12) United States Patent
Benyassine et al.

(10) Patent No.: US 7,146,309 B1
(45) Date of Patent: Dec. 5, 2006

(54) DERIVING SEED VALUES TO GENERATE EXCITATION VALUES IN A SPEECH CODER

(75) Inventors: Adil Benyassine, Irvine, CA (US); Eyal Shlomot, Irvine, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 421 days.

(21) Appl. No.: 10/653,874

(22) Filed: Sep. 2, 2003

(51) Int. Cl.
*G10L 19/00* (2006.01)

(52) U.S. Cl. ..... 704/201

(58) Field of Classification Search ..... None
See application file for complete search history.

(56) References Cited

U.S. PATENT DOCUMENTS

| | | | | |
|---|---|---|---|---|
| 5,699,478 | A | 12/1997 | Nahumi | |
| 5,778,338 | A | 7/1998 | Jacobs et al. | |
| 6,085,158 | A | 7/2000 | Naka | |
| 6,240,386 | B1 | 5/2001 | Thyssen et al. | |
| 6,385,578 | B1 | 5/2002 | Lee et al. | |
| 6,636,829 | B1 * | 10/2003 | Benyassine et al. | 704/201 |

FOREIGN PATENT DOCUMENTS

EP 0 852 376 A2 7/1998

EP 0 883 107 A1 12/1998

OTHER PUBLICATIONS

Publication entitled "Enhanced Variable Rate Codec, Speech Service Option 3 for Wideband Spread Spectrum Digital System", by Telecommunications Industry Associates 1997, Arlington, Va (Jan. 1997), Document No. TIA/EIA/IS-127.

Kataoka A et al: "ITU-T 8-KBIT/S Standard Speech Codec for Personal Communication Services" 1995 Fourth IEEE International Conference on Universal Personal Communications Record. Gateway to the 21st Century. Tokyo, Nov. 6-10, 1995, IEEE International Conference on Universal Personal Communications, New York, IEEE, US, vol. Conf. 4, Nov. 6, 1995, pp. 818-822, XP000690065 ISBN: 0-7803-2955-4 abstract p. 821, right-hand column, paragraphs 8., —p. 822, left-hand column, line 2.

* cited by examiner

*Primary Examiner*—Susan McFadden
(74) *Attorney, Agent, or Firm*—Farjami & Farjami LLP

(57) ABSTRACT

There are provided methods and devices for generating excitation values for a speech signal. In one aspect, an example method comprises obtaining one or more characteristics of a first speech frame of the speech signal, deriving a first seed value based on the one or more characteristics of the first speech frame, providing the first seed value to a Gaussian time series generator; and using the Gaussian time series generator to generate an excitation values for the first frame. The one or more characteristics may include a spectrum information of the first frame, an energy information of the first frame, or a gain information of the first frame.

42 Claims, 9 Drawing Sheets

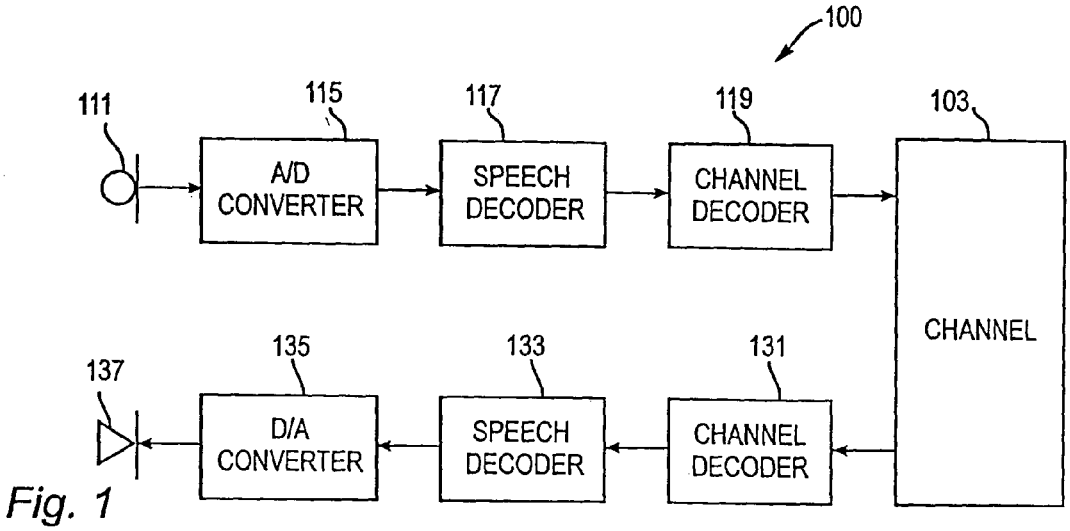
Fig. 1
Fig. 2
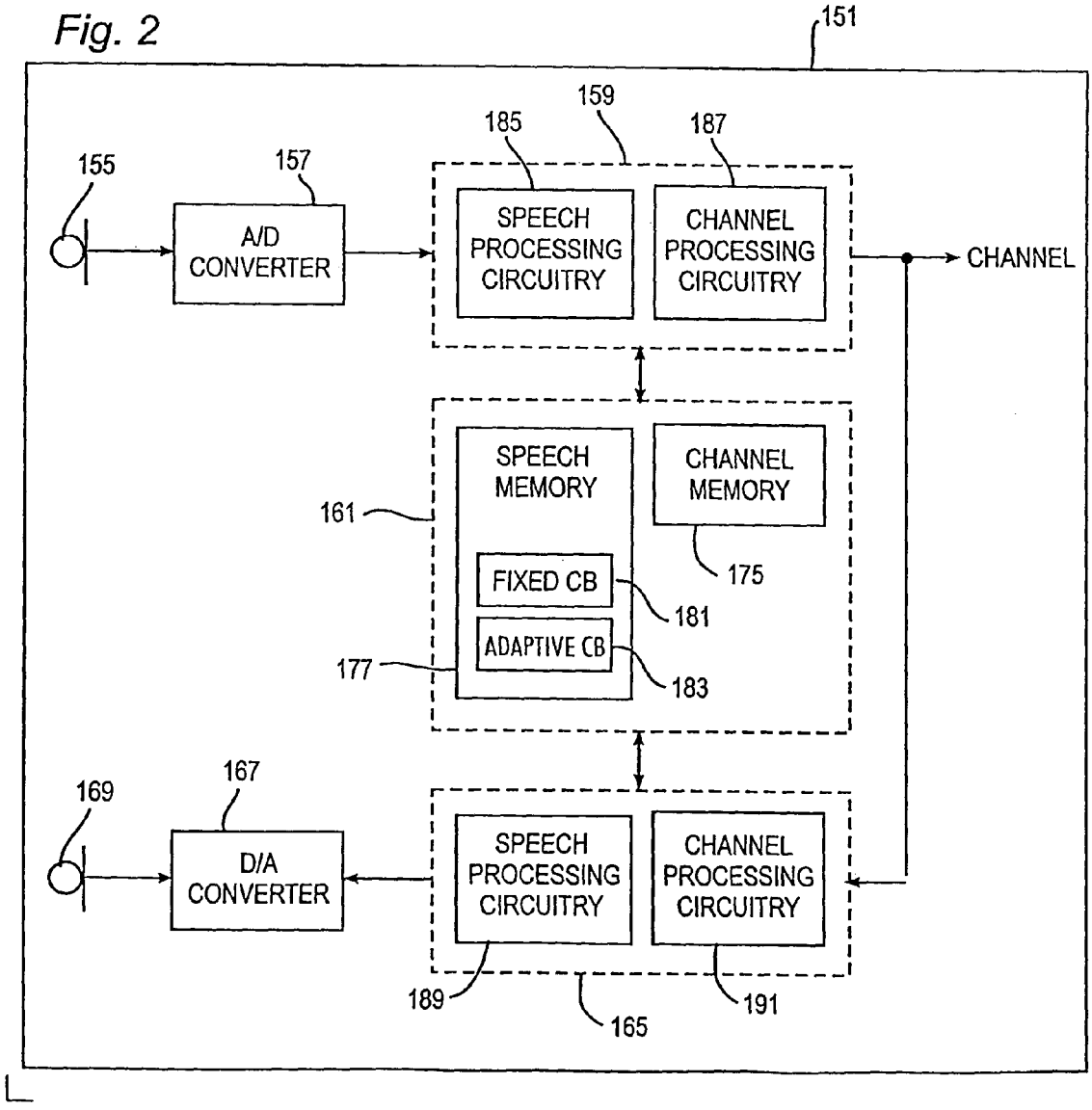

FIG. 9

| frame 0 | frame 1 | frame 2 | frame 3 |
|---|---|---|---|
| received | lost | received | received |

FIG. 10

| | received | lost | received | received | received | received |
|---|---|---|---|---|---|---|
| | frame 0 | frame 1 | frame 2 | frame 3 | frame 4 | frame 5 |
| prior art: | 60 Hz | 60 Hz | 60 Hz | 60 Hz | 60 Hz | 60 Hz |
| new way: | 60 Hz | 90 Hz | 80 Hz | 70 Hz | 60 Hz | 60 Hz |

FIG. 11

| | will be lost | | |
|---|---|---|---|
| frame 1 | frame 2 | frame 3 | frame 4 |
| pitch lag L1 | pitch lag L2 | pitch lag L3 | pitch lag L4 |
| delta (L1 - L0) | delta (L2 - L1) | delta (L3 - L2) | delta (L4 - L3) |

FIG. 12

| | will be lost | | |
|---|---|---|---|
| frame 1 | frame 2 | frame 3 | frame 4 |
| pitch lag L1 | pitch lag L2 | pitch lag L3 | pitch lag L4 |

FIG. 13

| received | lost | received | received | lost | lost | lost | lost |
|---|---|---|---|---|---|---|---|
| frame 1 | frame 2 | frame 3 | frame 4 | frame 5 | frame 6 | frame 7 | frame 8 |
| | 0.95 | | | 0.95 | 0.90 | 0.85 | 0.80 |

FIG. 14

| speech | noise | noise | noise | speech | noise | speech |
|---|---|---|---|---|---|---|
| frame 0 | frame 1 | frame 2 | frame 3 | frame 4 | frame 5 | frame 6 |
| | seed 1 | seed 2 | seed 3 | | seed 4 | |

FIG. 15

| received speech | LOST ~~noise~~ "speech" | received noise | noise | speech | noise | speech |
|---|---|---|---|---|---|---|
| frame 0 | frame 1 | frame 2 | frame 3 | frame 4 | frame 5 | frame 6 |
| | | seed 1 | seed 2 | | seed 3 | |

DERIVING SEED VALUES TO GENERATE EXCITATION VALUES IN A SPEECH CODER

INCORPORATION BY REFERENCE

The following U.S. patent applications are hereby incorporated by reference in their entireties and made part of the present application:

U.S. patent application Ser. No. 09/156,650, titled "Speech Encoder Using Gain Normalization That Combines Open And Closed Loop Gains," filed Sep. 18, 1998;

Provisional U.S. Patent Application Ser. No. 60/155,321 titled "4 kbits/s Speech Coding," filed Sep. 22, 1999; and U.S. patent application Ser. No. 09/574,396 titled "A New Speech Gain Quantization Strategy," filed May 19, 2000.

BACKGROUND OF THE INVENTION

The field of the present invention relates generally to the encoding and decoding of speech in voice communication systems and, more particularly to a method and apparatus for handling erroneous or lost frames.

To model basic speech sounds, speech signals are sampled over time and stored in frames as a discrete waveform to be digitally processed. However, in order to increase the efficient use of the communication bandwidth for speech, speech is coded before being transmitted especially when speech is intended to be transmitted under limited bandwidth constraints. Numerous algorithms have been proposed for the various aspects of speech coding. For example, an analysis-by-synthesis coding approach may be performed on a speech signal. In coding speech, the speech coding algorithm tries to represent characteristics of the speech signal in a manner which requires less bandwidth. For example, the speech coding algorithm seeks to remove redundancies in the speech signal. A first step is to remove short-term correlations. One type of signal coding technique is linear predictive coding (LPC). In using a LPC approach, the speech signal value at any particular time is modeled as a linear function of previous values. By using a LPC approach, short-term correlations can be reduced and efficient speech signal representations can be determined by estimating and applying certain prediction parameters to represent the signal. The LPC spectrum, which is an envelope of short term correlations in the speech signal, may be represented, for example, by LSF's (line spectral frequencies). After the removal of short-term correlations in a speech signal, a LPC residual signal remains. This residual signal contains periodicity information that needs to be modeled. The second step in removing redundancies in speech is to model the periodicity information. Periodicity information may be modeled by using pitch prediction. Certain portions of speech have periodicity while other portions do not. For example, the sound "aah" has periodicity information while the sound "shhh" has no periodicity information.

In applying the LPC technique, a conventional source encoder operates on speech signals to extract modeling and parameter information to be coded for communication to a conventional source decoder via a communication channel. One way to code modeling and parameter information into a smaller amount of information is to use quantization. Quantization of a parameter involves selecting the closest entry in a table or codebook to represent the parameter. Thus, for example, a parameter of 0.125 may be represented by 0.1 if the codebook contains 0, 0.1, 0.2, 0.3, etc. Quantization includes scalar quantization and vector quantization.

In scalar quantization, one selects the entry in the table or codebook that is the closest approximation to the parameter, as described above. By contrast, vector quantization combines two or more parameters and selects the entry in the table or codebook which is closest to the combined parameters. For example, vector quantization may select the entry in the codebook that is the closest to the difference between the parameters. A codebook used to vector quantize two parameters at once is often referred to as a two-dimensional codebook. A n-dimensional codebook quantizes n parameters at once.

Quantized parameters may be packaged into packets of data which are transmitted from the encoder to the decoder. In other words, once coded, the parameters representing the input speech signal are transmitted to a transceiver. Thus, for example, the LSF's may be quantized and the index into a codebook may be converted into bits and transmitted from the encoder to the decoder. Depending on the embodiment, each packet may represent a portion of a frame of the speech signal, a frame of speech, or more than a frame of speech. At the transceiver, a decoder receives the coded information. Because the decoder is configured to know the manner in which speech signals are encoded, the decoder decodes the coded information to reconstruct a signal for playback that sounds to the human ear like the original speech. However, it may be inevitable that at least one packet of data is lost during transmission and the decoder does not receive all of the information sent by the encoder. For instance, when speech is being transmitted from a cell phone to another cell phone, data may be lost when reception is poor or noisy. Therefore, transmitting the coded modeling and parameter information to the decoder requires a way for the decoder to correct or adjust for lost packets of data. While the prior art describes certain ways of adjusting for lost packets of data such as by extrapolation to try to guess what the information was in the lost packet, these methods are limited such that improved methods are needed.

Besides LSF information, other parameters transmitted to the decoder may be lost. In CELP (Code Excited Linear Prediction) speech coding, for example, there are two types of gain which are also quantized and transmitted to the decoder. The first type of gain is the pitch gain GO, also known as the adaptive codebook gain. The adaptive codebook gain is sometimes referred to, including herein, with the subscript "a" instead of the subscript "p". The second type of gain is the fixed codebook gain $G_C$. Speech coding algorithms have quantized parameters including the adaptive codebook gain and the fixed codebook gain. Other parameters may, for example, include pitch lags which represent the periodicity of voiced speech. If the speech encoder classifies speech signals, the classification information about the speech signal may also be transmitted to the decoder. For an improved speech encoder/decoder that classifies speech and operates in different modes, see U.S. patent application Ser. No. 09/574,396 titled "A New Speech Gain Quantization Strategy," filed May 19, 2000, which was previously incorporated herein by reference.

Because these and other parameter information are sent over imperfect transmission means to the decoder, some of these parameters are lost or never received by the decoder. For speech communication systems that transmit a packet of information per frame of speech, a lost packet results in a lost frame of information. In order to reconstruct or estimate the lost information, prior art systems have tried different approaches, depending on the parameter lost. Some approaches simply use the parameter from the previous frame that actually was received by the decoder. These prior art approaches have their disadvantages, inaccuracies and problems. Thus, there is a need for an improved way to correct or adjust for lost information so as to recreate a speech signal as close as possible to the original speech signal.

Certain prior art speech communication systems do not transmit a fixed codebook excitation from the encoder to the decoder in order to save bandwidth. Instead, these systems have a local Gaussian time series generator that uses an initial fixed seed to generate a random excitation value and then updates that seed every time the system encounters a frame containing silence or background noise. Thus, the seed changes for every noise frame. Because the encoder and decoder have the same Gaussian time series generator that uses the same seeds in the same sequence, they generate the same random excitation value for noise frames. However, if a noise frame is lost and not received by the decoder, the encoder and decoder use different seeds for the same noise frame, thereby losing their synchronicity. Thus, there is a need for a speech communication system that does not transmit fixed codebook excitation values to the decoder, but which maintains synchronicity between the encoder and decoder when a frame is lost during transmission.

SUMMARY OF THE INVENTION

Various separate aspects of the present invention can be found in a speech communication system and method that has an improved way of handling information lost during transmission from the encoder to the decoder. In particular, the improved speech communication system is able to generate more accurate estimates for the information lost in a lost packet of data. For example, the improved speech communication system is able to handle more accurately lost information such as LSF, pitch lag (or adaptive codebook excitation), fixed codebook excitation and/or gain information. In an embodiment of a speech communication system that does not transmit fixed codebook excitation values to the decoder, the improved encoder/decoder are able to generate the same random excitation values for a given noise frame even if a previous noise frame was lost during transmission.

A first, separate aspect of the present invention is a speech communication system that handles lost LSF information by setting the minimum spacing between LSF's to an increased value and then decreasing the value for subsequent frames in a controlled adaptive manner.

A second, separate aspect of the present invention is a speech communication system that estimates a lost pitch lag by extrapolating from the pitch lags of a plurality of the preceding received frames.

A third, separate aspect of the present invention is a speech communication system that receives the pitch lag of the succeeding received frame and uses curve fitting between the pitch lag of the preceding received frame and the pitch lag of the succeeding received frame to fine tune its estimation of the pitch lag for the lost frame so as to adjust or correct the adaptive codebook buffer prior to its use by subsequent frames.

A fourth, separate aspect of the present invention is a speech communication system that estimates a lost gain parameter for periodic-like speech differently than it estimates a lost gain parameter for non-periodic like speech.

A fifth, separate aspect of the present invention is a speech communication system that estimates a lost adaptive codebook gain parameter differently than it estimates a lost fixed codebook gain parameter.

A sixth, separate aspect of the present invention is a speech communication system that determines a lost adaptive codebook gain parameter for a lost frame of non-periodic like speech based on the average adaptive codebook gain parameter of the subframes of an adaptive number of previously received frames.

A seventh, separate aspect of the present invention is a speech communication system that determines a lost adaptive codebook gain parameter for a lost frame of non-periodic like speech based on the average adaptive codebook gain parameter of the subframes of an adaptive number of previously received frames and the ratio of the adaptive codebook excitation energy to the total excitation energy.

An eighth, separate aspect of the present invention is a speech communication system that determines a lost adaptive codebook gain parameter for a lost frame of non-periodic like speech based on the average adaptive codebook gain parameter of the subframes of an adaptive number of previously received frames, the ratio of the adaptive codebook excitation energy to the total excitation energy, the spectral tilt of the previously received frame and/or energy of the previously received frame.

A ninth, separate aspect of the present invention is a speech communication system that sets a lost adaptive codebook gain parameter for a lost frame of non-periodic like speech to an arbitrarily high number.

A tenth, separate aspect of the present invention is a speech communication system that sets a lost fixed codebook gain parameter to zero for all subframes of a lost frame of non-periodic like speech.

An eleventh, separate aspect of the present invention is a speech communication system that determines a lost fixed codebook gain parameter for the current subframe of the lost frame of non-periodic like speech based on the ratio of the energy of the previously received frame to the energy of the lost frame.

A twelfth, separate aspect of the present invention is a speech communication system that determines a lost fixed codebook gain parameter for the current subframe of the lost frame based on the ratio of the energy of the previously received frame to the energy of the lost frame and then attenuates that parameter to set the lost fixed codebook gain parameters for the remaining subframes of the lost frame.

A thirteenth, separate aspect of the present invention is a speech communication system that sets a lost adaptive codebook gain parameter for the first frame of periodic like speech to be lost after a received frame to an arbitrarily high number.

A fourteenth, separate aspect of the present invention is a speech communication system that sets a lost adaptive codebook gain parameter for the first frame of periodic like speech to be lost after a received frame to an arbitrarily high number and then attenuates that parameter to set the lost adaptive codebook gain parameters for the remaining subframes of the lost frame.

A fifteenth, separate aspect of the present invention is a speech communication system that sets a lost fixed codebook gain parameter for a lost frame of periodic like speech to zero if the average adaptive codebook gain parameter of a plurality of the previously received frames exceeds a threshold.

A sixteenth, separate aspect of the present invention is a speech communication system that determines a lost fixed codebook gain parameter for the current subframe of a lost frame of periodic like speech based on the ratio of the energy of the previously received frame to the energy of the lost frame if the average adaptive codebook gain parameter of a plurality of the previously received frames does not exceed a threshold.

A seventeenth, separate aspect of the present invention is a speech communication system that determines a lost fixed codebook gain parameter for the current subframe of a lost frame based on the ratio of the energy of the previously received frame to the energy of the lost frame and then attenuates that parameter to set the lost fixed codebook gain parameters for the remaining subframes of the lost frame if the average adaptive codebook gain parameter of a plurality of the previously received frames exceeds a threshold.

An eighteenth, separate aspect of the present invention is a speech communication system that randomly generates a fixed codebook excitation for a given frame by using a seed whose value is determined by information in that frame.

A nineteenth, separate aspect of the present invention is a speech communication decoder that after estimating lost parameters in a lost frame and synthesizing the speech, matches the energy of the synthesized speech to the energy of the previously received frame.

A twentieth, separate aspect of the present invention is any of the above separate aspects, either individually or in some combination.

Further separate aspects of the present invention can also be found in a method of encoding and/or decoding a speech signal that practices any of the above separate aspects, either individually or in some combination.

Other aspects, advantages and novel features of the present invention will become apparent from the following Detailed Description Of A Preferred Embodiment, when considered in conjunction with the accompanying figures.

BRIEF DESCRIPTION OF THE FIGURES

FIG. 1 is a functional block diagram of a speech communication system having a source encoder and source decoder.

FIG. 2 is a more detailed functional block diagram of the speech communication system of FIG. 1.

FIG. 9 illustrates a hypothetical example of received frames and a lost frame.

FIG. 10 illustrates a hypothetical example of received frames and a lost frame as well as the minimum spacings between LSF's assigned to each frame in a prior art system and a speech communication system built in accordance with the present invention.

FIG. 11 illustrates a hypothetical example showing how a prior art speech communication system assigns and uses pitch lag and delta pitch lag information for each frame.

FIG. 12 illustrates a hypothetical example showing how a speech communication system built in accordance with the present invention assigns and uses pitch lag and delta pitch lag information for each frame.

FIG. 13 illustrates a hypothetical example showing how a speech decoder built in accordance with the present invention assigns adaptive gain parameter information for each frame when there is a lost frame.

FIG. 14 illustrates a hypothetical example showing how a prior art encoder uses seeds to generate a random excitation value for each frame containing silence or background noise.

FIG. 15 illustrates a hypothetical example showing how a prior art decoder uses seeds to generate a random excitation value for each frame containing silence or background noise and loses synchronicity with the encoder if there is a lost frame.

DETAILED DESCRIPTION OF A PREFERRED EMBODIMENT

Figure 3:
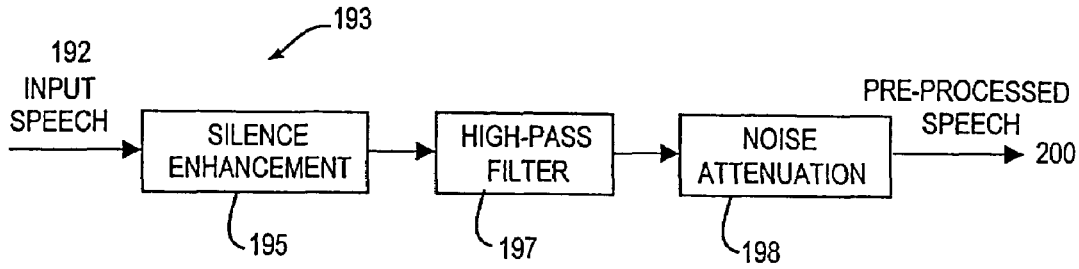
FIG. 3 is a functional block diagram of an exemplary first stage, a speech pre-processor, of the source encoder used by one embodiment of the speech communication system of FIG. 1.

First a general description of the overall speech communication system is described, and then a detailed description of an embodiment of the present invention is provided.

FIG. 1 is a schematic block diagram of a speech communication system illustrating the general use of a speech encoder and decoder in a communication system. A speech communication system 100 transmits and reproduces speech across a communication channel 103. Although it may comprise for example a wire, fiber, or optical link, the communication channel 103 typically comprises, at least in part, a radio frequency link that often must support multiple, simultaneous speech exchanges requiring shared bandwidth resources such as may be found with cellular telephones.

A storage device may be coupled to the communication channel 103 to temporarily store speech information for delayed reproduction or playback, e.g., to perform answering machine functions, voiced email, etc. Likewise, the communication channel 103 might be replaced by such a storage device in a single device embodiment of the communication system 100 that, for example, merely records and stores speech for subsequent playback.

In particular, a microphone 111 produces a speech signal in real time. The microphone 111 delivers the speech signal to an A/D (analog to digital) converter 115. The A/D converter 115 converts the analog speech signal into a digital form and then delivers the digitized speech signal to a speech encoder 117.

The speech encoder 117 encodes the digitized speech by using a selected one of a plurality of encoding modes. Each of the plurality of encoding modes uses particular techniques that attempt to optimize the quality of the resultant reproduced speech. While operating in any of the plurality of modes, the speech encoder 117 produces a series of modeling and parameter information (e.g., "speech parameters") and delivers the speech parameters to an optional channel encoder 119.

The optional channel encoder 119 coordinates with a channel decoder 131 to deliver the speech parameters across the communication channel 103. The channel decoder 131 forwards the speech parameters to a speech decoder 133. While operating in a mode that corresponds to that of the speech encoder 117, the speech decoder 133 attempts to recreate the original speech from the speech parameters as accurately as possible. The speech decoder 133 delivers the reproduced speech to a D/A (digital to analog) converter 135 so that the reproduced speech may be heard through a speaker 137.

FIG. 2 is a functional block diagram illustrating an exemplary communication device of FIG. 1. A communication device 151 comprises both a speech encoder and decoder for simultaneous capture and reproduction of speech. Typically within a single housing, the communication device 151 might, for example, comprise a cellular telephone, portable telephone, computing system, or some other communication device. Alternatively, if a memory element is provided for storing encoded speech information, the communication device 151 might comprise an answering machine, a recorder, voice mail system, or other communication memory device.

A microphone 155 and an A/D converter 157 deliver a digital voice signal to an encoding system 159. The encoding system 159 performs speech encoding and delivers resultant speech parameter information to the communication channel. The delivered speech parameter information may be destined for another communication device (not shown) at a remote location.

As speech parameter information is received, a decoding system 165 performs speech decoding. The decoding system delivers speech parameter information to a D/A converter 167 where the analog speech output may be played on a speaker 169. The end result is the reproduction of sounds as similar as possible to the originally captured speech.

The encoding system 159 comprises both a speech processing circuit 185 that performs speech encoding and an optional channel processing circuit 187 that performs the optional channel encoding. Similarly, the decoding system 165 comprises a speech processing circuit 189 that performs speech decoding and an optional channel processing circuit 191 that performs channel decoding.

Although the speech processing circuit 185 and the optional channel processing circuit 187 are separately illustrated, they may be combined in part or in total into a single unit. For example, the speech processing circuit 185 and the channel processing circuitry 187 may share a single DSP (digital signal processor) and/or other processing circuitry. Similarly, the speech processing circuit 189 and optional the channel processing circuit 191 may be entirely separate or combined in part or in whole. Moreover, combinations in whole or in part may be applied to the speech processing circuits 185 and 189, the channel processing circuits 187 and 191, the processing circuits 185, 187, 189 and 191, or otherwise as appropriate. Further, each or all of the circuits which control aspects of the operation of the decoder and/or encoder may be referred to as a control logic and may be implemented, for example, by a microprocessor, microcontroller, CPU (central processing unit), ALU (arithmetic logic unit), a co-processor, an ASIC (application specific integrated circuit), or any other kind of circuit and/or software.

The encoding system 159 and the decoding system 165 both use a memory 161. The speech processing circuit 185 uses a fixed codebook 181 and an adaptive codebook 183 of a speech memory 177 during the source encoding process. Similarly, the speech processing circuit 189 uses the fixed codebook 181 and the adaptive codebook 183 during the source decoding process.

Although the speech memory 177 as illustrated is shared by the speech processing circuits 185 and 189, one or more separate speech memories can be assigned to each of the processing circuits 185 and 189. The memory 161 also contains software used by the processing circuits 185, 187, 189 and 191 to perform various functions required in the source encoding and decoding processes.

Before discussing the details of an embodiment of the improvement in speech coding, an overview of the overall speech encoding algorithm is provided at this point. The improved speech encoding algorithm referred to in this specification may be, for example, the eX-CELP (extended CELP) algorithm which is based on the CELP model. The details of the eX-CELP algorithm is discussed in a U.S. patent application assigned to the same assignee, Conexant Systems, Inc., and previously incorporated herein by reference: Provisional U.S. Patent Application Ser. No. 60/155,321 titled "4 kbits/s Speech Coding," filed Sep. 22, 1999.

In order to achieve toll quality at a low bit rate (such as 4 kilobits per second), the improved speech encoding algorithm departs somewhat from the strict waveform-matching criterion of traditional CELP algorithms and strives to capture the perceptually important features of the input signal. To do so, the improved speech encoding algorithm analyzes the input signal according to certain features such as degree of noise-like content, degree of spiky-like content, degree of voiced content, degree of unvoiced content, evolution of magnitude spectrum, evolution of energy contour, evolution of periodicity, etc., and uses this information to control weighting during the encoding and quantization process. The philosophy is to accurately represent the perceptually important features and allow relatively larger errors in less important features. As a result, the improved speech encoding algorithm focuses on perceptual matching instead of waveform matching. The focus on perceptual matching results in satisfactory speech reproduction because of the assumption that at 4 kbits per second, waveform matching is not sufficiently accurate to capture faithfully all information in the input signal. Consequently, the improved speech encoder performs some prioritizing to achieve improved results.

In one particular embodiment, the improved speech encoder uses a frame size of 20 milliseconds, or 160 samples per second, each frame being divided into either two or three subframes. The number of subframes depends on the mode of subframe processing. In this particular embodiment, one of two modes may be selected for each frame of speech: Mode 0 and Mode 1. Importantly, the manner in which subframes are processed depends on the mode. In this particular embodiment, Mode 0 uses two subframes per frame where each subframe size is 10 milliseconds in duration, or contains 80 samples. Likewise, in this example embodiment, Mode 1 uses three subframes per frame where the first and second subframes are 6.625 milliseconds in duration, or contains 53 samples, and the third subframe is 6.75 milliseconds in duration, or contains 54 samples. In both Modes, a look-ahead of 15 milliseconds may be used. For both Modes 0 and 1, a tenth order Linear Prediction (LP) model may be used to represent the spectral envelope of the signal. The LP model may be coded in the Line Spectrum Frequency (LSF) domain by using, for example, a delayed-decision, switched multi-stage predictive vector quantization scheme.

Mode 0 operates a traditional speech encoding algorithm such as a CELP algorithm. However, Mode 0 is not used for all frames of speech. Instead, Mode 0 is selected to handle frames of all speech other than "periodic-like" speech, as discussed in greater detail below. For convenience, "periodic-like" speech is referred to here as periodic speech, and all other speech is "non-periodic" speech. Such "non-periodic" speech include transition frames where the typical parameters such as pitch correlation and pitch lag change rapidly and frames whose signal is dominantly noise-like. Mode 0 breaks each frame into two subframes. Mode 0 codes the pitch lag once per subframe and has a two-dimensional vector quantizer to jointly code the pitch gain (i.e., adaptive codebook gain) and the fixed codebook gain once per subframe. In this example enbodiment, the fixed codebook contains two pulse sub-codebooks and one Gaussian sub-codebook; the two pulse sub-codebooks have two and three pulses, respectively.

Mode 1 deviates from the traditional CELP algorithm. Mode 1 handles frames containing periodic speech which typically have high periodicity and are often well represented by a smooth pitch tract. In this particular embodiment, Mode 1 uses three subframes per frame. The pitch lag is coded once per frame prior to the subframe processing as part of the pitch pre-processing and the interpolated pitch tract is derived from this lag. The three pitch gains of the subframes exhibit very stable behavior and are jointly quantized using pre-vector quantization based on a mean-squared error criterion prior to the closed loop subframe processing. The three reference pitch gains which are unquantized are derived from the weighted speech and are a byproduct of the frame-based pitch pre-processing. Using the pre-quantized pitch gains, the traditional CELP subframe processing is performed, except that the three fixed codebook gains are left unquantized. The three fixed codebook gains are jointly quantized after subframe processing which is based on a delayed decision approach using a moving average prediction of the energy. The three subframes are subsequently synthesized with fully quantized parameters.

The manner in which the mode of processing is selected for each frame of speech based on the classification of the speech contained in the frame and the innovative way in which periodic speech is processed allows for gain quantization with significantly fewer bits without any significant sacrifice in the perceptual quality of the speech. Details of this manner of processing speech are provided below.

Figure 4:
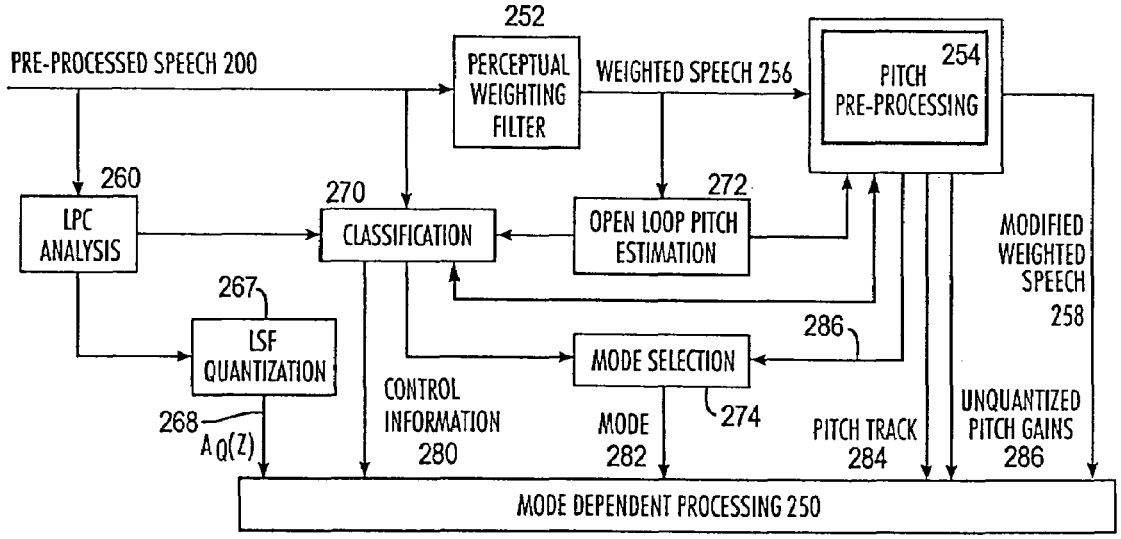
FIG. 4 is a functional block diagram illustrating an exemplary second stage of the source encoder used by one embodiment of the speech communication system of FIG. 1.
Figure 5:
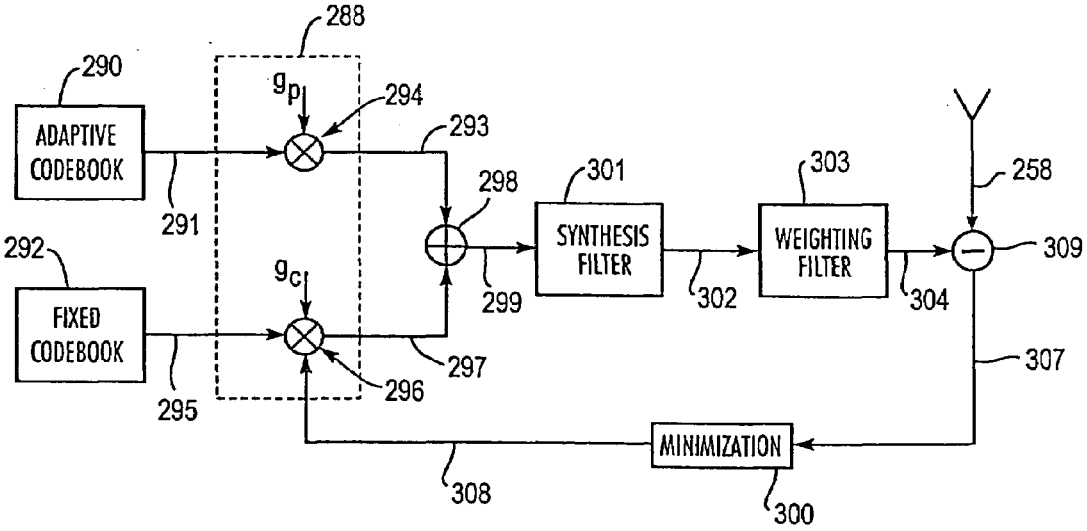
FIG. 5 is a functional block diagram illustrating an exemplary third stage of the source encoder used by one embodiment of the speech communication system of FIG. 1.
Figure 6:
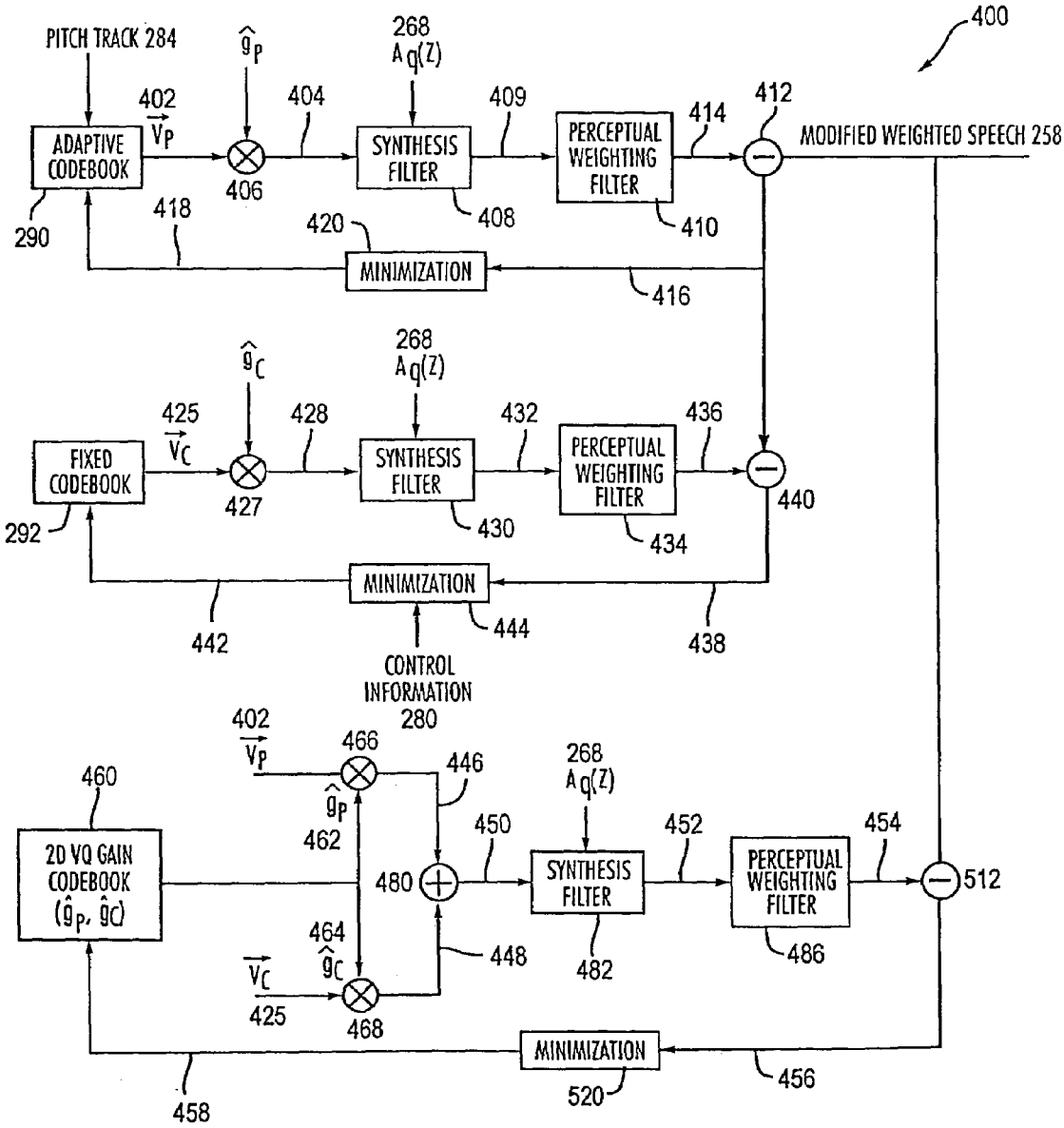
FIG. 6 is a functional block diagram illustrating an exemplary fourth stage of the source encoder used by one embodiment of the speech communication system of FIG. 1 for processing non-periodic speech (mode 0).
Figure 7:
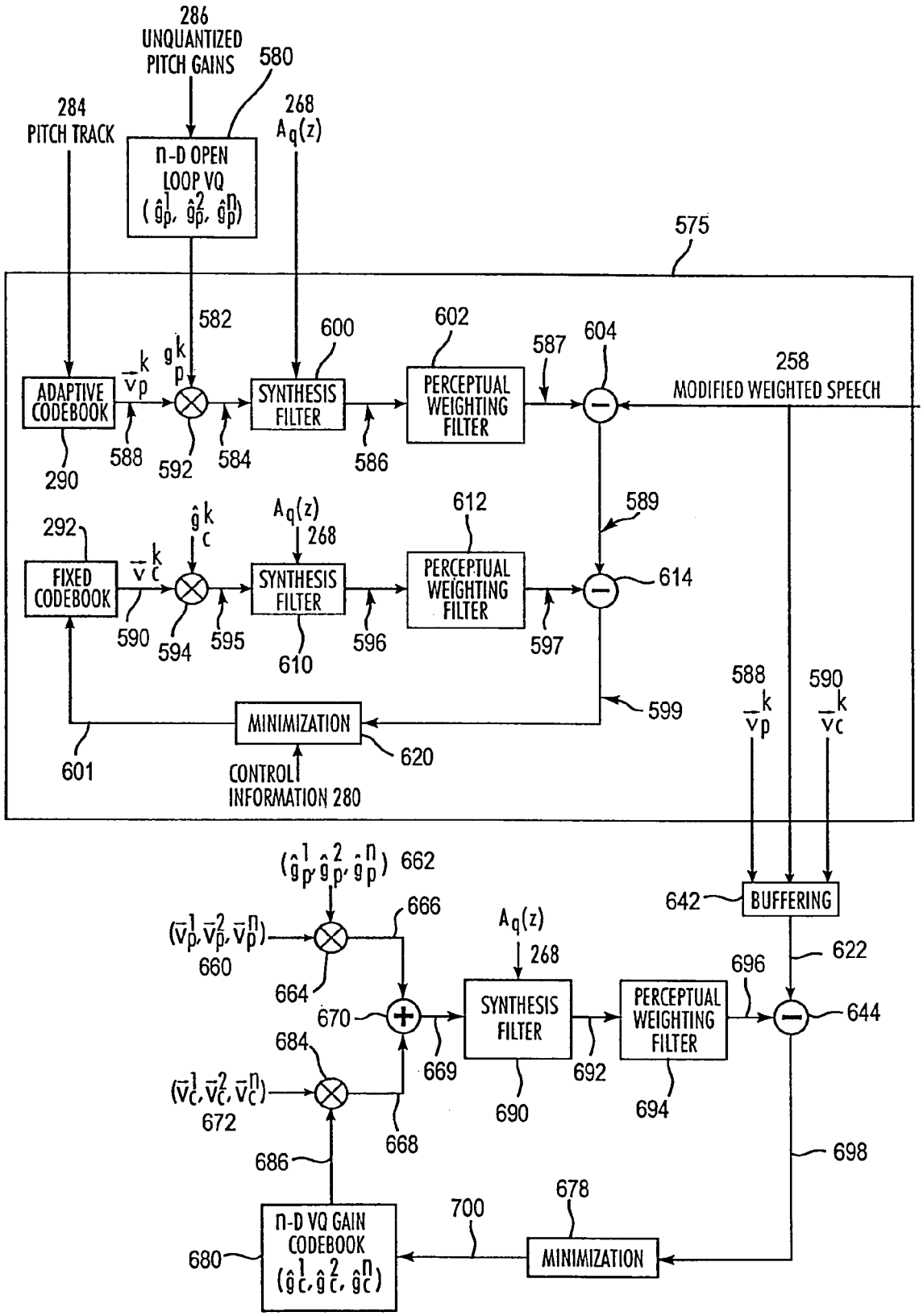
FIG. 7 is a functional block diagram illustrating an exemplary fourth stage of the source encoder used by one embodiment of the speech communication system of FIG. 1 for processing periodic speech (mode 1).

FIGS. 3–7 are functional block diagrams illustrating a multi-stage encoding approach used by one embodiment of the speech encoder illustrated in FIGS. 1 and 2. In particular, FIG. 3 is a functional block diagram illustrating a speech pre-processor 193 that comprises the first stage of the multi-stage encoding approach; FIG. 4 is a functional block diagram illustrating the second stage; FIGS. 5 and 6 are functional block diagrams depicting Mode 0 of the third stage; and FIG. 7 is a functional block diagram depicting Mode 1 of the third stage. The speech encoder, which comprises encoder processing circuitry, typically operates under software instruction to carry out the following functions.

Input speech is read and buffered into frames. Turning to the speech pre-processor 193 of FIG. 3, a frame of input speech 192 is provided to a silence enhancer 195 that determines whether the frame of speech is pure silence, i.e., only "silence noise" is present. The speech enhancer 195 adaptively detects on a frame basis whether the current frame is purely "silence noise." If the signal 192 is "silence noise," the speech enhancer 195 ramps the signal to the zero-level of the signal 192. Otherwise, if the signal 192 is not "silence noise," the speech enhancer 195 does not modify the signal 192. The speech enhancer 195 cleans up the silence portions of the clean speech for very low level noise and thus enhances the perceptual quality of the clean speech. The effect of the speech enhancement function becomes especially noticeable when the input speech originals from an A-law source; that is, the input has passed through A-law encoding and decoding immediately prior to processing by the present speech coding algorithm. Because A-law amplifies sample values around 0 (e.g., −1, 0, +1) to either −8 or +8, the amplification in A-law could transform an inaudible silence noise into a clearly audible noise. After processing by the speech enhancer 195, the speech signal is provided to a high-pass filter 197.

The high-pass filter 197 eliminates frequencies below a certain cutoff frequency and permits frequencies higher than the cutoff frequency to pass to a noise attenuator 199. In this particular embodiment, the high-pass filter 197 is identical to the input high-pass filter of the G.729 speech coding standard of ITU-T. Namely, it is a second order pole-zero filter with a cut-off frequency of 140 hertz (Hz). Of course, the high-pass filter 197 need not be such a filter and may be constructed to be any kind of appropriate filter known to those of ordinary skill in the art.

The noise attenuator 199 performs a noise suppression algorithm. In this particular embodiment, the noise attenuator 199 performs a weak noise attenuation of a maximum of 5 decibels (dB) of the environmental noise in order to improve the estimation of the parameters by the speech encoding algorithm. The specific methods of enhancing silence, building a high-pass filter 197 and attenuating noise may use any one of the numerous techniques known to those of ordinary skill in the art. The output of the speech pre-processor 193 is pre-processed speech 200.

Of course, the silence enhancer 195, high-pass filter 197 and noise attenuator 199 may be replaced by any other device or modified in a manner known to those of ordinary skill in the art and appropriate for the particular application.

Turning to FIG. 4, a functional block diagram of the common frame-based processing of a speech signal is provided. In other words, FIG. 4 illustrates the processing of a speech signal on a frame-by-frame basis. This frame processing occurs regardless of the mode (e.g., Modes 0 or 1) before the mode-dependent processing 250 is performed. The pre-processed speech 200 is received by a perceptual weighting filter 252 that operates to emphasize the valley areas and de-emphasize the peak areas of the pre-processed speech signal 200. The perceptual weighting filter 252 may be replaced by any other device or modified in a manner known to those of ordinary skill in the art and appropriate for the particular application.

A LPC analyzer 260 receives the pre-processed speech signal 200 and estimates the short term spectral envelope of the speech signal 200. The LPC analyzer 260 extracts LPC coefficients from the characteristics defining the speech signal 200. In one embodiment, three tenth-order LPC analyses are performed for each frame. They are centered at the middle third, the last third and the lookahead of the frame. The LPC analysis for the lookahead is recycled for the next frame as the LPC analysis centered at the first third of the frame. Thus, for each frame, four sets of LPC parameters are generated. The LPC analyzer 260 may also perform quantization of the LPC coefficients into, for example, a line spectral frequency (LSF) domain. The quantization of the LPC coefficients may be either scalar or vector quantization and may be performed in any appropriate domain in any manner known in the art.

A classifier 270 obtains information about the characteristics of the pre-processed speech 200 by looking at, for example, the absolute maximum of frame, reflection coefficients, prediction error, LSF vector from the LPC analyzer 260, the tenth order autocorrelation, recent pitch lag and recent pitch gains. These parameters are known to those of ordinary skill in the art and for that reason, are not further explained here. The classifier 270 uses the information to control other aspects of the encoder such as the estimation of signal-to-noise ratio, pitch estimation, classification, spectral smoothing, energy smoothing and gain normalization. Again, these aspects are known to those of ordinary skill in the art and for that reason, are not further explained here. A brief summary of the classification algorithm is provided next.

The classifier 270, with help from the pitch preprocessor 254, classifies each frame into one of six classes according to the dominating feature of the frame. The classes are (1) Silence/background Noise; (2) Noise/Like Unvoiced Speech; (3) Unvoiced; (4) Transition (includes onset); (5) Non-Stationary Voiced; and (6) Stationary Voiced. The classifier 270 may use any approach to classify the input signal into periodic signals and non-periodic signals. For example, the classifier 270 may take the pre-processed speech signal, the pitch lag and correlation of the second half of the frame, and other information as input parameters.

Various criteria can be used to determine whether speech is deemed to be periodic. For example, speech may be considered periodic if the speech is a stationary voiced signal. Some people may consider periodic speech to include stationary voiced speech and non-stationary voiced speech, but for purposes of this specification, periodic speech includes stationary voiced speech. Furthermore, periodic speech may be smooth and stationary speech. A voice speech is considered to be "stationary" when the speech signal does not change more than a certain amount within a frame. Such a speech signal is more likely to have a well defined energy contour. A speech signal is "smooth" if the adaptive codebook gain $G_P$ of that speech is greater than a threshold value. For example, if the threshold value is 0.7, a speech signal in a subframe is considered to be smooth if its adaptive codebook gain $G_P$ is greater than 0.7. Non-periodic speech, or non-voiced speech, includes unvoiced speech (e.g., fricatives such as the "shhh" sound), transitions (e.g., onsets, offsets), background noise and silence.

More specifically, in the example embodiment, the speech encoder initially derives the following parameters:

Spectral Tilt (estimation of first reflection coefficient 4 times per frame):

$$\kappa(k) = \frac{\sum_{n=1}^{L-1} s_k(n)\cdot s_k(n-1)}{\sum_{n=0}^{L-1} s_k(n)^2} \quad k = 0, 1, \ldots, 3, \tag{1}$$

where L=80 is the window over which the reflection coefficient is calculated and $s_k(n)$ is the $k^{th}$ segment given by $$S_k(n)=s(k\cdot 40-20+n)\cdot w_h(n),\ n=0,1,\ldots 79, \tag{2}$$

where $w_h(n)$ is a 80 sample Hamming window and s(0), s(1), . . . , s(159) is the current frame of the pre-processed speech signal.

Absolute Maximum (tracking of absolute signal maximum, 8 estimates per frame):

$$\chi(k)=\max\{s(n)|n=n_s(k),n_s(k)+1,\ldots,n_e(k)-1\},\ k=0,1,\ldots,7 \tag{3}$$

where $n_s(k)$ and $n_e(k)$ is the starting point and end point, respectively, for the search of the $k^{th}$ maximum at time k·160/8 samples of the frame. In general, the length of the segment is 1.5 times the pitch period and the segments overlap. Thus, a smooth contour of the amplitude envelope can be obtained.

The Spectral Tilt, Absolute Maximum, and Pitch Correlation parameters form the basis for the classification. However, additional processing and analysis of the parameters are performed prior to the classification decision. The parameter processing initially applies weighting to the three parameters. The weighting in some sense removes the background noise component in the parameters by subtracting the contribution from the background noise. This provides a parameter space that is "independent" from any background noise and thus is more uniform and improves the robustness of the classification to background noise.

Running means of the pitch period energy of the noise, the spectral tilt of the noise, the absolute maximum of the noise, and the pitch correlation of the noise are updated eight times per frame according to the following equations, Equations 4–7. The following parameters defined by Equations 4–7 are estimated/sampled eight times per frame, providing a fine time resolution of the parameter space:

Running mean of the pitch period energy of the noise:

$$\langle E_{N,P}(k)\rangle=\alpha_1\cdot\langle E_{N,P}(k-1)\rangle+(1-\alpha_1)\cdot E_P(k), \tag{4}$$

where $E_{N,P}(k)$ is the normalized energy of the pitch period at time k·160/8 samples of the frame. The segments over which the energy is calculated may overlap since the pitch period typically exceeds 20 samples (160 samples/8).

Running means of the spectral tilt of the noise:

$$\langle\kappa_N(k)\rangle=\alpha_1\cdot\langle\kappa_N(k-1)\rangle+(1-\alpha_1)\cdot\kappa(k \bmod 2). \tag{5}$$

Running mean of the absolute maximum of the noise:

$$\langle\chi_N(k)\rangle=\alpha_1\cdot\langle X_N(k-1)\rangle+(1-\alpha_1)\cdot\chi(k). \tag{6}$$

Running mean of the pitch correlation of the noise:

$$\langle R_{N,P}(k)\rangle=\alpha_1\cdot\langle R_{N,P}(k-1)\rangle+(1-\alpha_1)\cdot R_P. \tag{7}$$

where $R_P$ is the input pitch correlation for the second half of the frame. The adaptation constant $\alpha_1$ is adaptive, though the typical value is $\alpha_1$=0.99. The background noise to signal ratio is calculated according to $$\gamma(k) = \sqrt{\frac{\langle E_{N,P}(k)\rangle}{E_P(k)}}. \tag{8}$$

The parametric noise attenuation is limited to 30 dB, i.e., $$\gamma(k)=\{\gamma(k)>0.968?0.968:\gamma(k)\} \tag{9}$$

The noise free set of parameters (weighted parameters) is obtained by removing the noise component according to the following Equations 10–12:

Estimation of weighted spectral tilt:

$$\kappa_w(k)=\kappa(k \bmod 2)-\gamma(k)\cdot\langle\kappa_N(k)\rangle. \tag{10}$$

Estimation of weighted absolute maximum:

$$\chi_w(k)=\chi(k)-y(k)\cdot\langle\chi_N(k)\rangle. \tag{11}$$

Estimation of weighted pitch correlation:

$$R_{w,p}(k)=R_p-\gamma(k)\cdot\langle R_{N,p}(k)\rangle. \tag{12}$$

The evolution of the weighted tilt and the weighted maximum is calculated according to the following Equations 13 and 14, respectively, as the slope of the first order approximation:

$$\partial\kappa_w(k)=\frac{\sum_{l=1}^{7} l\cdot(\chi_w(k-7+l)-\chi_w(k-7))}{\sum_{l=1}^{7} l^2} \tag{13}$$

$$\partial\kappa_w(k)=\frac{\sum_{l=1}^{7} l\cdot(\kappa_w(k-7+1)-\kappa_w(k-7))}{\sum_{l=1}^{7} l^2} \tag{14}$$

Once the parameters of Equations 4 through 14 are updated for the eight sample points of the frame, the following frame-based parameters are calculated from the parameters of Equations 4–14:

Maximum weighted pitch correlation:

$$R_{w,p}^{\max}=\max\{R_{w,p}(k-7+l),\ l=0,1,\ldots,7\} \tag{15}$$

Average weighted pitch correlation:

$$R_{w,p}^{avg}=\frac{1}{8}\sum_{l=0}^{7} R_{w,p}(k-7+l). \tag{16}$$

Running mean of average weighted pitch correlation:

$$\langle R_{w,p}^{avg}(m)\rangle=\alpha_2\cdot\langle R_{w,p}^{avg}(m-1)\rangle+(1-\alpha_2)\cdot R_{w,p}^{avg}, \tag{17}$$

where m is the frame number and $\alpha_2$=0.75 is the adaptation constant. Normalized standard deviation of pitch lag:

$$\sigma_{L_p}(m)=\frac{1}{\mu_{L_p}(m)}\sqrt{\frac{\sum_{l=0}^{2}\left(L_p(m-2+1)-\mu_{L_p}(m)\right)^2}{3}}, \tag{18}$$

where $L_p(m)$ is the input pitch lag and $\mu_{L_p}(m)$ is the mean of the pitch lag over the past three frames given by $$\mu_{L_p}(m)=\frac{1}{3}\sum_{l=0}^{2}(L_p(m-2+1). \tag{19}$$

Minimum weighted spectral tilt:

$$\kappa_n^{\min}=\min\{\kappa_w(k-7+l),\ l=0,1,\ldots,7\} \tag{20}$$

Running mean of minimum weighted spectral tilt:

$$\langle\kappa_w^{\min}(m)\rangle=\alpha_2\cdot\langle\kappa_w^{\min}(m-1)\rangle+(1-\alpha_2)\cdot\kappa_w^{\min}. \tag{21}$$

Average weighted spectral tilt:

$$\kappa_w^{avg}=\frac{1}{8}\sum_{l=0}^{7}\kappa_w(k-7+l). \tag{22}$$

Minimum slope of weighted tilt:

$$\partial\kappa_w^{\min}=\min\{\partial\kappa_w(k-7+l),\ l=0,1,\ldots,7\}. \tag{23}$$

Accumulated slope of weighted spectral tilt:

$$\partial\kappa_w^{acc}=\sum_{l=0}^{7}\partial\kappa_w(k-7+l). \tag{24}$$

Maximum slope of weighted maximum:

$$\partial\chi_w^{\max}=\max\{\partial\chi_w(k-7+l),\ l=0,1,\ldots,7\} \tag{25}$$

Accumulated slope of weighted maximum:

$$\partial\chi_w^{acc}=\sum_{l=0}^{7}\partial\chi_w(k-7+l). \tag{26}$$

The parameters given by Equations 23, 25, and 26 are used to mark whether a frame is likely to contain an onset, and the parameters given by Equations 16–18, 20–22 are used to mark whether a frame is likely to be dominated by voiced speech. Based on the initial marks, past marks and other information, the frame is classified into one of the six classes.

A more detailed description of the manner in which the classifier 270 classifies the pre-processed speech 200 is described in a U.S. patent application assigned to the same assignee, Conexant Systems, Inc., and previously incorporated herein by reference: Provisional U.S. Patent Application Ser. No. 60/155,321 titled "4 kbits/s Speech Coding," filed Sep. 22, 1999.

The LSF quantizer 267 receives the LPC coefficients from the LPC analyzer 260 and quantizes the LPC coefficients. The purpose of LSF quantization, which may be any known method of quantization including scalar or vector quantization, is to represent the coefficients with fewer bits. In this particular embodiment, LSF quantizer 267 quantizes the tenth order LPC model. The LSF quantizer 267 may also smooth out the LSFs in order to reduce undesired fluctuations in the spectral envelope of the LPC synthesis filter. The LSF quantizer 267 sends the quantized coefficients $A_q$ (z) 268 to the subframe processing portion 250 of the speech encoder. The subframe processing portion of the speech encoder is mode dependent. Though LSF is preferred, the quantizer 267 can quantize the LPC coefficients into a domain other than the LSF domain.

If pitch pre-processing is selected, the weighted speech signal 256 is sent to the pitch preprocessor 254. The pitch preprocessor 254 cooperates with the open loop pitch estimator 272 in order to modify the weighted speech 256 so that its pitch information can be more accurately quantized. The pitch preprocessor 254 may, for example, use known compression or dilation techniques on pitch cycles in order to improve the speech encoder's ability to quantize the pitch gains. In other words, the pitch preprocessor 254 modifies the weighted speech signal 256 in order to match better the estimated pitch track and thus more accurately fit the coding model while producing perceptually indistinguishable reproduced speech. If the encoder processing circuitry selects a pitch pre-processing mode, the pitch preprocessor 254 performs pitch pre-processing of the weighted speech signal 256. The pitch preprocessor 254 warps the weighted speech signal 256 to match interpolated pitch values that will be generated by the decoder processing circuitry. When pitch pre-processing is applied, the warped speech signal is referred to as a modified weighted speech signal 258. If pitch pre-processing mode is not selected, the weighted speech signal 256 passes through the pitch pre-processor 254 without pitch pre-processing (and for convenience, is still referred to as the "modified weighted speech signal" 258). The pitch preprocessor 254 may include a waveform interpolator whose function and implementation are known to those of ordinary skill in the art. The waveform interpolator may modify certain irregular transition segments using known forward-backward waveform interpolation techniques in order to enhance the regularities and suppress the irregularities of the speech signal. The pitch gain and pitch correlation for the weighted signal 256 are estimated by the pitch preprocessor 254. The open loop pitch estimator 272 extracts information about the pitch characteristics from the weighted speech 256. The pitch information includes pitch lag and pitch gain information.

The pitch preprocessor 254 also interacts with the classifier 270 through the open-loop pitch estimator 272 to refine the classification by the classifier 270 of the speech signal. Because the pitch preprocessor 254 obtains additional information about the speech signal, the additional information can be used by the classifier 270 in order to fine tune its classification of the speech signal. After performing pitch pre-processing, the pitch preprocessor 254 outputs pitch track information 284 and unquantized pitch gains 286 to the mode-dependent subframe processing portion 250 of the speech encoder.

Once the classifier 270 classifies the pre-processed speech 200 into one of a plurality of possible classes, the classification number of the pre-processed speech signal 200 is sent to the mode selector 274 and to the mode-dependent subframe processor 250 as control information 280. The mode selector 274 uses the classification number to select the mode of operation. In this particular embodiment, the classifier 270 classifies the pre-processed speech signal 200 into one of six possible classes. If the pre-processed speech signal 200 is stationary voiced speech (e.g., referred to as "periodic" speech), the mode selector 274 sets mode 282 to Mode 1. Otherwise, mode selector 274 sets mode 282 to Mode 0. The mode signal 282 is sent to the mode dependent subframe processing portion 250 of the speech encoder. The mode information 282 is added to the bitstream that is transmitted to the decoder.

The labeling of the speech as "periodic" and "non-periodic" should be interpreted with some care in this particular embodiment. For example, the frames encoded using Mode 1 are those maintaining a high pitch correlation and high pitch gain throughout the frame based on the pitch track 284 derived from only seven bits per frame. Consequently, the selection of Mode 0 rather than Mode 1 could be due to an inaccurate representation of the pitch track 284 with only seven bits and not necessarily due to the absence of periodicity. Hence, signals encoded using Mode 0 may very well contain periodicity, though not well represented by only seven bits per frame for the pitch track. Therefore, the Mode 0 encodes the pitch track with seven bits twice per frame for a total of fourteen bits per frame in order to represent the pitch track more properly.

Each of the functional blocks on FIGS. 3–4, and the other FIGs in this specification, need not be discrete structures and may be combined with another one or more functional blocks as desired.

Figure 8:
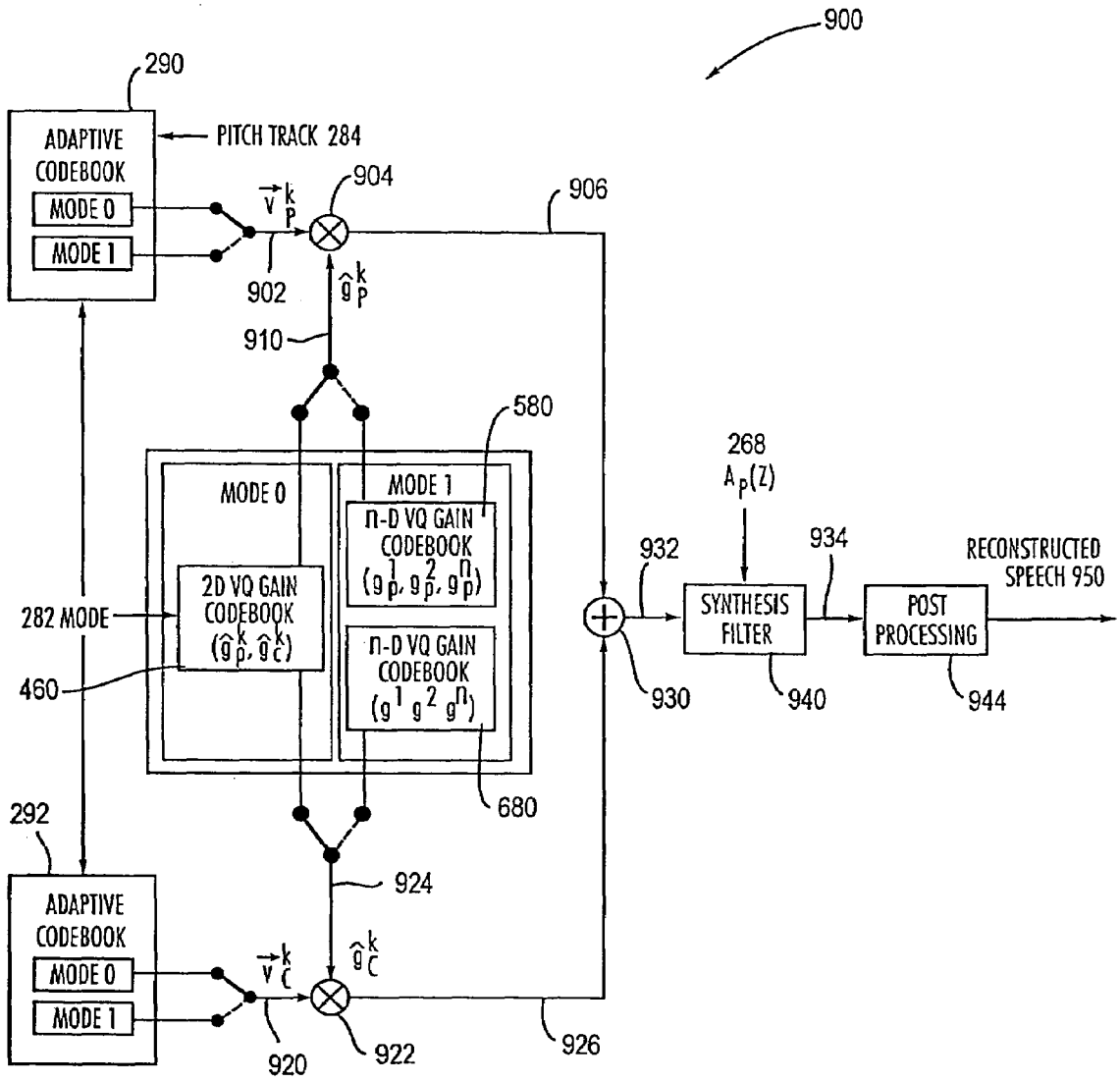
FIG. 8 is a block diagram of one embodiment of a speech decoder for processing coded information from a speech encoder built in accordance with the present invention.

The mode-dependent subframe processing portion 250 of the speech encoder operates in two modes of Mode 0 and Mode 1. FIGS. 5–6 provide functional block diagrams of the Mode 0 subframe processing while FIG; 7 illustrates the functional block diagram of the Mode 1 subframe processing of the third stage of the speech encoder. FIG. 8 illustrates a block diagram of a speech decoder that corresponds with the improved speech encoder. The speech decoder performs inverse mapping of the bit-stream to the algorithm parameters followed by a mode-dependent synthesis. A more detailed description of these figures and modes is provided in a U.S. patent application assigned to the same assignee, Conexant Systems, Inc., the entire application was previously incorporated herein by reference, U.S. patent application Ser. No. 09/574,396 titled "A NEW SPEECH GAIN QUANTIZATION STRATEGY," filed May 19, 2000.

The quantized parameters representing the speech signal may be packetized and then transmitted in packets of data from the encoder to the decoder. In the example embodiment described next, the speech signal is analyzed frame by frame, where each frame may have at least one subframe, and each packet of data contains information for one frame. Thus, in this example, the parameter information for each frame is transmitted in a packet of information. In other words, there is one packet for each frame. Of course, other variations are possible and depending on the embodiment, each packet could represent a portion of a frame, more than a frame of speech, or a plurality of frames.

LSF

A LSF (line spectral frequency) is a representation of the LPC spectrum (i.e., the short term envelope of the speech spectrum). LSF's can be regarded as particular frequencies at which the speech spectrum is sampled. If, for example, the system uses a $10^{th}$ order LPC, there would be 10 LSF's per frame. There must be a minimum spacing between consecutive LSF's so that they do not create quasi-unstable filters. For example, if $f_i$ is the ith LSF and equals 100 Hz, the (i+1)st LSF, $f_{i+1}$ must be at least $f_i$+the minimum spacing.

For instance, if $f_i$=100 Hz and the minimum spacing is 60 Hz, $f_{I+1}$ must be at least 160 Hz and can be any frequency greater than 160 Hz. The minimum spacing is a fixed number that does not vary frame by frame and is known to both the encoder and decoder so that they can cooperate.

Let us assume that the encoder uses predictive coding to code the LSF's (as opposed to non-predictive coding) which is necessary to achieve speech communication at low bit rates. In other words, the encoder uses the quantized LSF of a previous frame or frames to predict the LSF of the current frame. The error between the predicted LSF and the true LSF of the current frame which the encoder derives from the LPC spectrum is quantized and transmitted to the decoder. The decoder determines the predicted LSF of the current frame in the same manner that the encoder did. Then by knowing the error which was transmitted by the encoder, the decoder can calculate the true LSF of the current frame. However, what happens if a frame containing LSF information is lost? Turning to FIG. 9, suppose that the encoder transmits frames 0–3, but the decoder only receives frames 0, 2 and 3. Frame 1 is the lost or "erased" frame. If the current frame is lost frame 1, the decoder does not have the error information that is necessary to calculate the true LSF. As a result, prior art systems did not calculate the true LSF and instead, set the LSF to be the LSF of the previous frame, or the average LSF of a certain number of previous frames. The problems with this approach are that the LSF of the current frame may be too inaccurate (compared to the true LSF) and the subsequent frames (i.e., frames 2, 3 in the example of FIG. 9) use an inaccurate LSF of frame 1 to determine their own LSF's. Consequently, the LSF extrapolation error introduced by a lost frame taints the accuracy of the LSF's of the subsequent frames.

In an example embodiment of the present invention, an improved speech decoder includes a counter that counts the number of good frames that follow the lost frame. FIG. 10 illustrates an example of the minimum LSF spacings associated with each frame. Suppose that good frame 0 is received by the decoder, but frame 1 is lost. Under the prior art approach, the minimum spacing between LSF's was a fixed number (60 Hz in FIG. 10) that does not change. By contrast, when the improved speech decoder notices a lost frame, it increases the minimum spacing of that frame so as to avoid creating a quasi-unstable filter. The amount of increase in this "controlled adaptive LSF spacing" depends on what increase in spacing would be best for that particular case. For example, the improved speech decoder may consider how the energy of the signal (or the power of the signal) evolved over time, how the frequency content (spectrum) of the signal evolved over time, and the counter to determine at what value the minimum spacing of the lost frame should be set. A person of ordinary skill in the art could run simple experiments to determine what minimum spacing value would be satisfactory to use. One advantage of analyzing the speech signal and/or its parameters to derive an appropriate LSF is that the resultant LSF may be closer to the true (but lost) LSF of that frame.

Adaptive Codebook Excitation (Pitch Lag)

The total excitation $e_T$ composed of the adaptive codebook excitation and the fixed codebook excitation is described by the following equation:

$$e_T = g_p * e_{xp} + g_c * e_{xc} \tag{27}$$

where $g_p$ and $g_c$ are the quantized adaptive codebook gain and fixed codebook gain respectively and $e_{xp}$ and $e_{xc}$ are the adaptive codebook excitation and fixed codebook excitation. A buffer (also called the adaptive codebook buffer) holds $e_T$ and its components from the previous frame. Based on the pitch lag parameter in the current frame, the speech communication system selects an $e_T$ from the buffer and uses it as $e_{xp}$ for the current frame. The values for $g_p$, $g_c$ and $e_{xc}$ are obtained from the current frame. The $e_{xp}$, $g_p$, $g_c$ and $e_{xc}$ are then plugged into the formula to calculate an $e_T$ for the current frame. The calculated $e_T$ and its components are stored for the current frame in the buffer. The process repeats whereby the buffered $e_T$ is then used as $e_{xp}$ for the next frame. Thus, the feedback nature of this encoding approach (which is replicated by the decoder) is apparent. Because the information in the equation are quantized, the encoder and decoder are synchronized. Note that the buffer is a type of an adaptive codebook (but is different than the adaptive codebook used for gain excitations).

FIG. 11 illustrates an example of the pitch lag information transmitted by the prior art speech system for four frames 1–4. The prior art encoder would transmit the pitch lag for the current frame and a delta value, where the delta value is the difference between the pitch lag of the current frame and the pitch lag of the previous frame. The EVRC (Enhanced Variable Rate Coder) standard specifies the use of the delta pitch lag. Thus, for example, the packet of information concerning frame 1 would include pitch lag L1 and delta (L1−L0) where L0 is the pitch lag of preceding frame 0; the packet of information concerning frame 2 would include pitch lag L2 and delta (L2−L1); the packet of information concerning frame 3 would include pitch lag L3 and delta (L3−L2); and so on. Note that the pitch lags of adjacent frames could be equal so delta values could be zero. If frame 2 was lost and never received by the decoder, the only information about the pitch lag available at the time of frame 2 is pitch lag L1 because the previous frame 1 was not lost. The loss of the pitch lag L2 and delta (L2−L1) information created two problems. The first problem is how to estimate an accurate pitch lag L2 for lost frame 2. The second problem is how to prevent the error in estimating the pitch lag L2 from creating errors in subsequent frames. Some prior art systems do not attempt to fix either problem.

In trying to resolve the first problem, some prior art systems use the pitch lag L1 from the previous good frame 1 as an estimated pitch lag L2' for the lost frame 2, even though any difference between the estimated pitch lag L2' and the true pitch lag L2 would be an error.

The second problem is how to prevent the error in estimated pitch lag L2' from creating errors in subsequent frames. Recall that, as previously discussed, the pitch lag of frame n is used to update the adaptive codebook buffer which in turn is used by subsequent frames. The error between estimated pitch lag L2' and the true pitch lag L2 would create an error in the adaptive codebook buffer which would then create an error in the subsequently received frames. In other words, the error in the estimated pitch lag L2' may result in the loss of synchronicity between the adaptive codebook buffer from the encoder's point of view and the adaptive codebook buffer from the decoder's point of view. As a further example, during processing of current lost frame 2, the prior art decoder would use estimate pitch lag L2' to be pitch lag L1 (which probably differs from true pitch lag L2) to retrieve $e_{xp}$ for frame 2. The use of an erroneous pitch lag therefore selects the wrong $e_{xp}$ for the frame 2, and this error propagates through the subsequent frames. To resolve this problem in the prior art, when frame 3 is received by the decoder, the decoder now has pitch lag L3 and delta (L3−L2) and can thus reverse calculate what true pitch lag L2 should have been. The true pitch lag L2 is simply pitch lag L3 minus the delta (L3−L2). Thus, the prior art decoder could correct the adaptive codebook buffer that is used by frame 3. Because the lost frame 2 has already been processed with the estimated pitch lag L2', it is too late to fix lost frame 2.

FIG. 12 illustrates a hypothetical case of frames to demonstrate the operation of an example embodiment of an improved speech communication system which both problemes due to lost pitch lag information. Suppose that frame 2 is lost and frames 0, 1, 3 and 4 are received. During the time that the decoder is processing lost frame 2, the improved decoder may use the pitch lag L1 from the previous frame 1. Alternatively and preferably, the improved decoder may perform an extrapolation based on the pitch lag(s) of the previous frame(s) to determine an estimated pitch lag L2', which may result in a more accurate estimation than pitch lag L1. Thus, for example, the decoder may use pitch lags L0 and L1 to extrapolate the estimated pitch lag L2'. The extrapolation method may be any extrapolation method such as a curve fitting method that assumes a smooth pitch contour from the past to estimate the lost pitch lag L2, one that uses an average of past pitch lags, or any other extrapolation method. This approach reduces the number of bits that is transmitted from the encoder to the decoder because the delta value need not be transmitted.

To solve the second problem, when the improved decoder receives frame 3, the decoder has the correct pitch lag L3. However, as explained above, the adaptive codebook buffer used by frame 3 may be incorrect due to any extrapolation error in estimating pitch lag L2'. The improved decoder seeks to correct errors in estimating pitch lag L2' in frame 2 from affecting frames after frame 2, but without having to transmit delta pitch lag information. Once the improved decoder obtains pitch lag L3, it uses an interpolation method such as a curve fitting method to adjust or fine tune its prior estimation of pitch lag L2'. By knowing pitch lags L1 and L3, the curve fitting method can estimate L2' more accurately than when pitch lag L3 was unknown. The result is a fine tuned pitch lag L2" which is used to adjust or correct the adaptive codebook buffer for use by frame 3. More particularly, the fine tuned pitch lag L2" is used to adjust or correct the quantized adaptive codebook excitation in the adaptive codebook buffer. Consequently, the improved decoder reduces the number of bits that must be transmitted while fine tuning pitch lag L2' in a manner which is satisfactory for most cases. Thus, in order to reduce the affect of any error in the estimation of pitch lag L2 on the subsequently received frames, the improved decoder may use the pitch lag L3 of the next frame 3 and the pitch lag L1 of the previously received frame 1 to fine tune the previous estimation of the pitch lag L2 by assuming a smooth pitch contour. The accuracy of this estimation approach based on the pitch lags of the received frames preceding and succeeding the lost frame may be very good because pitch contours are generally smooth for voiced speech.

Gains

During the transmission of frames from the encoder to the decoder, a lost frame also results in lost gain parameters such as the adaptive codebook gain $g_p$ and fixed codebook gain $g_c$. Each frame contains a plurality of subframes where each subframe has gain information. Thus, the loss of a frame results in lost gain information for each subframe of the frame. Speech communication systems have to estimate gain information for each subframe of the lost frame. The gain information for one subframe may differ from that of another subframe.

Prior art systems took various approaches to estimate the gains for subframes of the lost frame such as by using the gain from the last subframe of the previous good frame as the gains of each subframe of the lost frame. Another variation was to use the gain from the last subframe of the previous good frame as the gain of the first subframe of the lost frame and to attenuate this gain gradually before it is used as the gains of the next subframes of the lost frame. In other words, for example, if each frame has four subframes and frame 1 is received but frame 2 is lost, the gain parameters in the last subframe of received frame 1 are used as the gain parameters of the first subframe of lost frame 2, the gain parameters are then decreased by some amount and used as the gain parameters of the second subframe of lost frame 2, the gain parameters are decreased again and used as the gain parameters of the third subframe of lost frame 2, and the gain parameters are decreased still further and used as the gain parameters of the last subframe of lost frame 2. Still another approach was to examine the gain parameters of the subframes of a fixed number of previously received frames to calculate average gain parameters which are then used as the gain parameters of the first subframe of lost frame 2 where the gain parameters could be decreased gradually and used as the gain parameters of the remaining subframes of the lost frame. Yet another approach was to derive median gain parameters by examining the subframes of a fixed number of previously received frames and using the median values as the gain parameters of the first subframe of lost frame 2 where the gain parameters could be decreased gradually and used as the gain parameters of the remaining subframes of the lost frame. Notably, the prior art approaches did not perform different recovery methods to the adaptive codebook gains and the fixed codebook gains; they used the same recovery method on both types of gain.

The improved speech communication system may also handle lost gain parameters due to a lost frame. If the speech communication system differentiates between periodic-like speech and non-periodic like speech, the system may handle lost gain parameters differently for each type of speech. Moreover, the improved system handles lost adaptive codebook gains differently than it handles lost fixed codebook gains. Let us first examine the case of non-periodic like speech. To determine an estimated adaptive codebook gain $g_p$, the improved decoder computes an average $g_p$ of the subframes of an adaptive number of previously received frames. The pitch lag of the current frame (i.e., the lost frame), which was estimated by the decoder, is used to determine the number of previously received frames to examine. Generally, the larger the pitch lag, the greater the number of previously received frames to use to calculate an average $g_p$. Therefore, the improved decoder uses a pitch synchronized averaging approach to estimate the adaptive codebook gain $g_p$ for non-periodic like speech. The improved decoder then calculates a beta β which indicates how good the prediction of $g_p$ was, based on the following formula:

$$\beta = \text{adaptive codebook excitation energy/total excitation energy } e_T = \|g_p * e_{xp}\|^2 / (\|g_p * e_{xp}\|^2 + \|g_c * e_{xc}\|^2) \quad (28)$$

β varies from 0 to 1 and represents the percentage effect of the adaptive codebook excitation energy on the total excitation energy. The greater the β, the greater the effect of the adaptive codebook excitation energy. Although unnecessary, the improved decoder preferably treats nonperiodic-like speech and periodic-like speech differently.

Figure 16:
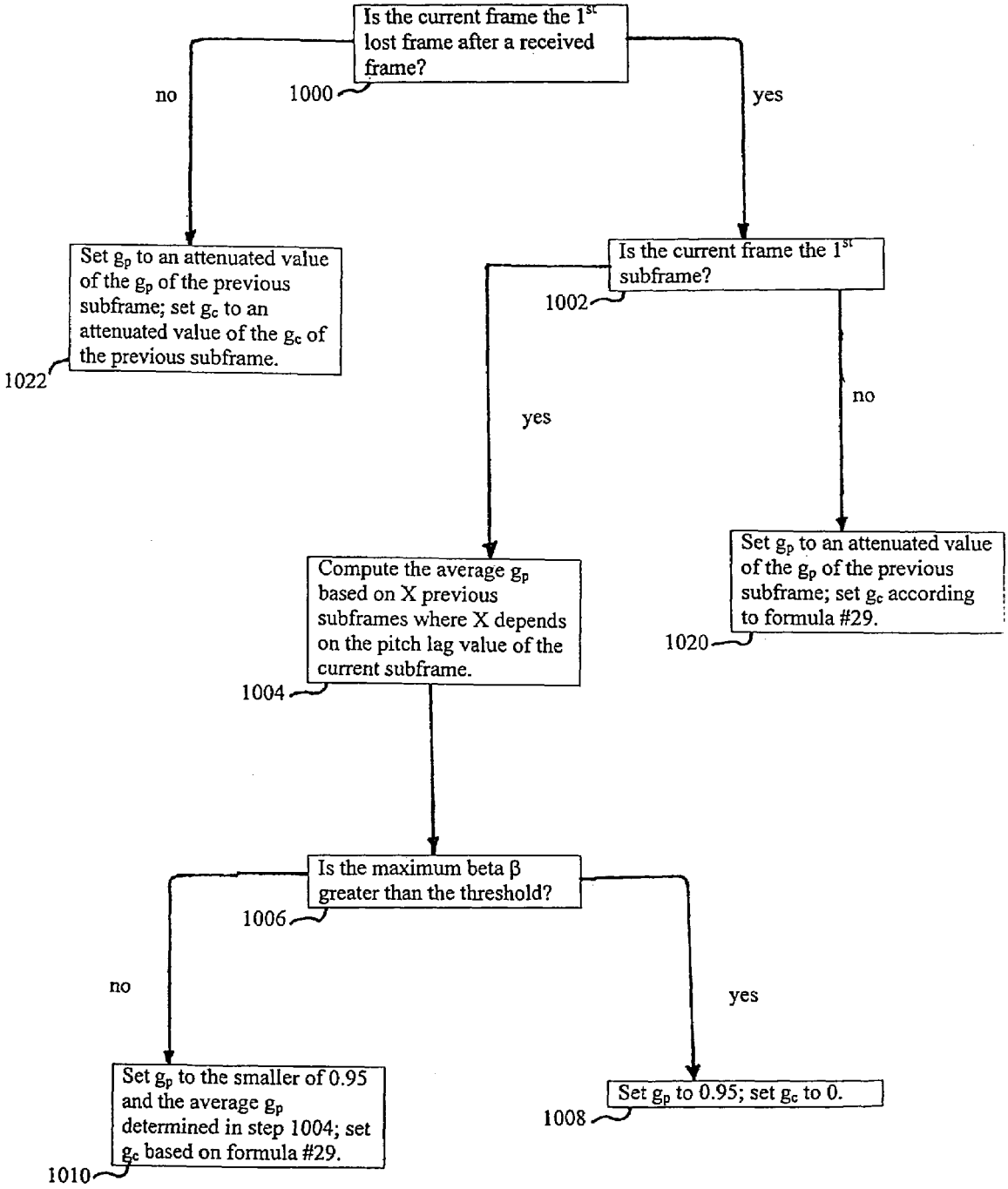
FIG. 16 is a flowchart showing an example processing of nonperiodic-like speech in accordance with the present invention.

FIG. 16 illustrates an example flowchart of the decoder's processing for nonperiodic-like speech. Step 1000 determines whether the current frame is the first frame lost after receiving a frame (i.e., a "good" frame). If the current frame is the first lost frame after a good frame, step 1002 determines whether the current subframe being processed by the decoder is the first subframe of a frame. If the current subframe is the first subframe, step 1004 computes an average $g_p$ for a certain number of previous subframes where the number of subframes depends on the pitch lag of the current subframe. In an example embodiment, if the pitch lag is less than or equal to 40, the average $g_p$ is based on two previous subframes; if the pitch lag is greater than 40 but less than or equal to 80, the average $g_p$ is based on four previous subframes; if the pitch lag is greater than 80 but less than or equal to 120, the average $g_p$ is based on six previous subframes; and if the pitch lag is greater than 120, the average $g_p$ is based on eight previous subframes. Of course, these values are arbitrary and may be set to any other values depending on the length of the subframe. Step 1006 determines whether the maximum β exceeds a certain threshold. If the maximum β exceeds a certain threshold, step 1008 sets the fixed codebook gain $g_c$ for all subframes of the lost frame to zero and sets $g_p$ for all subframes of the lost frame to an arbitrarily high number such as 0.95 instead of the average $g_p$ determined above. The arbitrarily high number indicates a good voicing signal. The arbitrarily high number to which $g_p$ of the current subframe of the lost frame is set may be based on a number of factors including, but not limited to, the maximum β of a certain number of previous frames, the spectral tilt of the previously received frame and the energy of the previously received frame.

Otherwise, if the maximum β does not exceed a certain threshold (i.e., a previously received frame contains the onset of speech), step 1010 sets the $g_p$ of the current subframe of the lost frame to be the minimum of (I) the average $g_p$ determined above and (ii) the arbitrarily selected high number (e.g., 0.95). Another alternative is to set the $g_p$ of the current subframe of the lost frame based on the spectral tilt of the previously received frame, the energy of the previously received frame, and the minimum of the average $g_p$ determined above and the arbitrarily selected high number (e.g., 0.95). In the case where the maximum β does not exceed a certain threshold, the fixed codebook gain $g_c$ is based on the energy of the gain scaled fixed codebook excitation in the previous subframe and the energy of the fixed codebook excitation in the current subframe. Specifically, the energy of the gain scaled fixed codebook excitation in the previous subframe is divided by the energy of the fixed codebook excitation in the current subframe, the result is square rooted and multiplied by an attenuation fraction and set to be $g_c$, as shown in the following formula:

$$g_c = \text{attenuation factor} * \text{square root}\left(\|g_c * e_{xc}\|_{i-1}^2 / \|e_{xc}\|_i^2\right) \quad (29)$$

Alternatively, the decoder may derive the $g_c$ for the current subframe of the lost frame to be based on the ratio of the energy of the previously received frame to the energy of the current lost frame.

Returning to step 1002, if the current subframe is not the $1^{st}$ subframe, step 1020 sets the $g_p$ of the current subframe of the lost frame to a value that is attenuated or reduced from the $g_p$ of the previous subframe. Each $g_p$ of the remaining subframes are set to a value further attenuated from the $g_p$ of the previous subframe. The $g_c$ of the current subframe is calculated in the same manner as it was in step 1010 and formula 29.

Returning to step 1000, if this is not the first lost frame after a good frame, step 1022 calculates the $g_c$ of the current subframe in the same manner as it was in step 1010 and formula 29. Step 1022 also sets the $g_p$ of the current subframe of the lost frame to a value that is attenuated or reduced from the $g_p$ of the previous subframe. Because the decoder estimates the $g_p$ and $g_c$ differently, the decoder may estimate them more accurately than the prior art systems.

Figure 17:
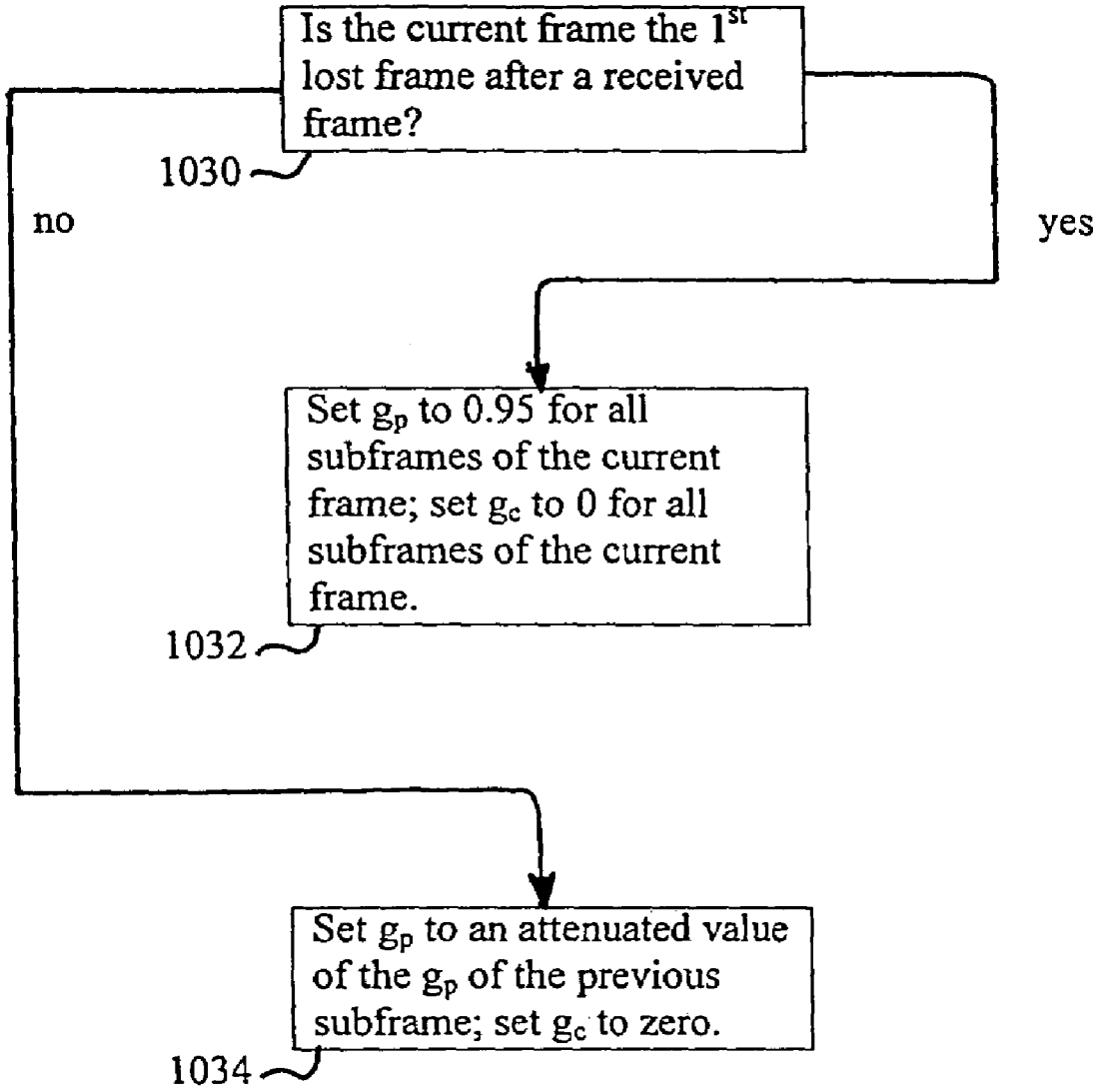
FIG. 17 is a flowchart of showing an example processing of periodic-like speech in accordance with the present invention.

Now let us examine the case of periodic-like speech in accordance with the example flowchart illustrated in FIG. 17. Because the decoder may apply different approaches to estimating $g_p$ and $g_c$ for periodic-like speech and non-periodic like speech, the estimation of the gain parameters may be more accurate than the prior art approaches. Step 1030 determines whether the current frame is the first frame lost after receiving a frame (i.e., a "good" frame). If the current frame is the first lost frame after a good frame, step 1032 sets $g_c$ to zero for all subframes of the current frame and sets $g_p$ to an arbitrarily high number such as 0.95 for all subframes of the current frame. If the current frame is not the first lost frame after a good frame (e.g., it is the $2^{nd}$ lost frame, $3^{rd}$ lost frame, etc), step 1034 sets $g_c$ to zero for all subframes of the current frame and sets $g_p$ to a value that is attenuated from the $g_p$ of the previous subframe.

FIG. 13 illustrates a case of frames to demonstrate the operation of the improved speech decoder. Suppose that frames 1, 3 and 4 are good (i.e., received) frames while frames 2, 5–8 are lost frames. If the current lost frame is the first lost frame after a good frame, the decoder sets $g_p$ to an arbitrarily high number (such as 0.95) for all subframes of the lost frame. Turning to FIG. 13, this would apply to lost frames 2 and 5. The $g_p$ of the first lost frame 5 is attenuated gradually to set the $g_p$'s of the other lost frames 6–8. Hence, for example, if $g_p$ is set to 0.95 for lost frame 5, $g_p$ could be set to 0.9 for lost frame 6 and 0.85 for lost frame 7 and 0.8 for lost frame 8. For $g_c$'s, the decoder computes the average $g_p$ from the previously received frames and if this average $g_p$ exceeds a certain threshold, $g_c$ is set to zero for all subframes of the lost frame. If the average $g_p$ does not exceed a certain threshold, the decoder uses the same approach of setting $g_c$ for non-periodic like signals described above to set $g_c$ here.

After the decoder estimates the lost parameters (e.g., LSF, pitch lags, gains, classification, etc) in a lost frame and synthesizes the resultant speech, the decoder can match the energy of the synthesized speech of the lost frame with the energy of the previously received frame through extrapolation techniques. This may further improve the accuracy of reproduction of the original speech despite lost frames.

Seed for Generating Fixed Codebook Excitations

In order to save bandwidth, a speech encoder need not transmit a fixed codebook excitation to the decoder during periods of background noise or silence. Instead, both the encoder and decoder can randomly generate an excitation value locally by using a Gaussian time series generator. Both the encoder and decoder are configured to generate the same random excitation value in the same order. As a result, because the decoder can locally generate the same random excitation value that the encoder generated for a given noise frame, the excitation value need not be transmitted from the encoder to the decoder. To generate a random excitation value, the Gaussian time series generator uses an initial seed to generate the first random excitation value and then the generator updates the seed to a new value. Then the generator uses the updated seed to generate the next random excitation value and updates the seed to yet another value. FIG. 14 illustrates a hypothetical case of frames to illustrate how a Gaussian time series generator in a speech encoder uses a seed to generate a random excitation value and then updates that seed to generate the next random excitation value. Suppose that frames 0 and 4 contain a speech signal while frames 2, 3 and 5 contain silence or background noise. Upon finding the first noise frame (i.e., frame 2), the encoder uses the initial seed (referred to as "seed 1") to generate a random excitation value to use as the fixed codebook excitation for that frame. For each sample of that frame, the seed is changed to generate a new fixed codebook excitation. Thus, if a frame were sampled 160 times, the seed would change 160 times. Thus, by the time the next noise frame is encountered (noise frame 3), the encoder uses a second and different seed (i.e., seed 2) to generate the random excitation value for that frame. Although technically, the seed for the first sample of the second frame is not the "second" seed because the seed has changed for every sample of the first frame, the seed for the first sample of the second frame is referred to herein as seed 2 for the sake of convenience. For noise frame 4, the encoder uses a third seed (different from the first and second seeds). To generate the random excitation value for noise frame 6, the Gaussian time series generator could either start over with seed 1 or proceed with seed 4, depending on the implementation of the speech communication system. By configuring the encoder and decoder to update the seed in the same manner, the encoder and decoder can generate the same seed and thus the same random excitation values in the same order. However, a lost frame destroys this synchronicity between the encoder and decoder in prior art speech communication systems.

FIG. 15 illustrates the hypothetical case presented in FIG. 14, but from the decoder's point of view. Suppose that noise frame 2 is lost and that frames 1 and 3 are received by the decoder. Because noise frame 2 is lost, the decoder assumes that it was of the same type as the previous frame 1 (i.e., a speech frame). Having made the wrong assumption about lost noise frame 2, the decoder presumes that noise frame 3 is the first noise frame when it is really the second noise frame encountered. Because the seeds are updated for each sample of every noise frame encountered, the decoder would erroneously use seed 1 to generate the random excitation value for noise frame 3 when seed 2 should have been used. The lost frame therefore resulted in lost synchronicity between the encoder and decoder. Because frame 2 is a noise frame, it is not significant that the decoder uses seed 1 while the encoder used seed 2 since the result is a different noise than the original noise. The same is true of frame 3. However, the error in seed values is significant for its impact on subsequently received frames containing speech. For example, let's focus on speech frame 4. The locally generated Gaussian excitation based on seed 2 is used to continually update the adaptive codebook buffer of frame 3. When frame 4 is processed, the adaptive codebook excitation is extracted from the adaptive codebook buffer of frame 3 based on information such as the pitch lag in frame 4. Because the encoder used seed 3 to update the adaptive codebook buffer of frame 3 and the decoder is using seed 2 (the wrong seed!) to update the adaptive codebook buffer of frame 3, the difference in updating the adaptive codebook buffer of frame 3 could create a quality problem in frame 4 in some cases.

The improved speech communication system built in accordance with the present invention does not use an initial fixed seed and then update that seed every time the system encounters a noise frame. Instead, the improved encoder and decoder derives the seed for a given frame from parameters in that frame. For example, the spectrum information, energy and/or gain information in the current frame could be used to generate the seed for that frame. For example, one could use the bits representing the spectrum (say 5 bits b1, b2, b3, b4, b5) and the bits representing the energy (say, 3 bits c1, c2, c3) to form a string b1, b2, b3, b4, b5, c1, c2, c3 whose value is the seed. As a numeric example, suppose that the spectrum is represented by 01101 and the energy is represented by 011, then the seed is 01101011. Certainly, other alternative methods of deriving a seed from information in the frame are possible and included within the scope of the invention. Consequently, in the example of FIG. 15 where noise frame 2 is lost, the decoder will be able to derive a seed for noise frame 3 that is the same seed derived by the encoder. Thus, a lost frame does not destroy the synchronicity between the encoder and decoder.

While embodiments and implementations of the subject invention have been shown and described, it should be apparent that many more embodiments and implementations are within the scope of the subject invention. Accordingly, the invention is not to be restricted, except in light of the claims and their equivalents.

What is claimed is:

1. A method of speech coding comprising:

obtaining one or more characteristics of a first frame of a speech signal;

deriving a first seed value based on said one or more characteristics of said first frame; and generating an excitation value for said first frame using said first seed value derived based on said one or more characteristics of said first frame.

2. The method of claim 1 further comprising: transmitting said one or more characteristics of said first frame.

3. The method of claim 1 further comprising:

determining one or more characteristics of a second frame of said speech signal;

deriving a second seed value based on said one or more characteristics of said second frame, wherein said second seed value is different than said first seed value; and generating an excitation value for said second frame using said second seed value derived based on said one or more characteristics of said second frame.

4. The method of claim 1, wherein said one or more characteristics include a spectrum information of said first frame.

5. The method of claim 1, wherein said one or more characteristics include an energy information of said first frame.

6. The method of claim 1, wherein said one or more characteristics include a gain information of said first frame.

7. The method of claim 6, wherein a plurality of bits represent said gain information, and wherein said plurality of bits are used to generate said first seed value.

8. The method of claim 1, wherein said one or more characteristics include an energy information of said first frame and a gain information of said first frame, and wherein a plurality of bits representing each of said information are combined to obtain said first seed value.

9. The method of claim 1, wherein said obtaining is performed by an encoder configured to analyze said first frame to determine said one or more characteristics.

10. The method of claim 1, wherein said obtaining is performed by a decoder configured to receive said one or more characteristics.

11. The method of claim 1, wherein said first frame is background noise or silence.

12. A speech coding device comprising:

a speech processing circuitry configured to obtain one or more characteristics of a first frame of a speech signal, and further configured to derive a first seed value based on said one or more characteristics of said first frame; and a generator configured to receive said first seed value and generate an excitation value for said first frame using said first seed value derived based on said one or more characteristics of said first frame.

13. The speech coding device of claim 12 further comprising a transmitter configured to transmit said one or more characteristics of said first frame.

14. The speech coding device of claim 12, wherein said speech processing circuitry is further configured to determine one or more characteristics of a second frame of said speech signal and derive a second seed value based on said one or more characteristics of said second frame, said second seed value being different than said first seed value, and wherein said generator is configured to receive said second seed value and generate an excitation value for said second frame using said second seed value derived based on said one or more characteristics of said second frame.

15. The speech coding device of claim 12, wherein said one or more characteristics include a spectrum information of said first frame.

16. The speech coding device of claim 12, wherein said one or more characteristics include an energy information of said first frame.

17. The speech coding device of claim 12, wherein said one or more characteristics include a gain information of said first frame.

18. The speech coding device of claim 17, wherein a plurality of bits represent said gain information, and wherein said plurality of bits are used to generate said first seed value.

19. The speech coding device of claim 12, wherein said one or more characteristics include an energy information of said first frame and a gain information of said first frame, and wherein a plurality of bits representing each of said information are combined to obtain said first seed value.

20. The speech coding device of claim 12, wherein said speech coding device is an encoder, and wherein said speech processing circuitry is configured to analyze said first frame to determine said one or more characteristics.

21. The speech coding device of claim 12, wherein said speech coding device is a decoder, said decoder including a receiver configured to receive said one or more characteristics.

22. The speech coding device of claim 12, wherein said first frame is background noise or silence.

23. A method of speech coding comprising:

obtaining a first set of bits from a plurality of bits representing a first frame of a plurality speech frames;

deriving a first seed value using said first set of bits from said plurality of bits representing said first frame of said plurality speech frames; and generating a first random excitation value using said first seed value.

24. The method of claim 23, wherein said random excitation value is a fixed codebook excitation.

25. The method of claim 23, wherein said one frame of a plurality speech frames is a silence frame.

26. The method of claim 23, wherein said one frame of a plurality speech frames is a noise frame.

27. The method of claim 23 further comprising:

obtaining a second set of bits from a plurality of bits representing a second frame of said plurality speech frames;

deriving a second seed value using said second set of bits from said plurality of bits representing said second frame of said plurality speech frames; and generating a second random excitation value using said second seed value.

28. The method of claim 23 further comprises repeating said obtaining, said deriving and said generating for each frame of said plurality speech frames.

29. The method of claim 23, wherein a decoder performs said obtaining, said deriving and said generating.

30. The method of claim 23, wherein an encoder performs said obtaining, said deriving and said generating.

31. The method of claim 23, wherein said first set of bits represent an energy.

32. The method of claim 23, wherein said first set of bits represent a spectrum.

33. A speech coding device comprising:

a speech processing circuitry configured to obtain a first set of bits from a plurality of bits representing a first frame of a plurality speech frames, and further configured to derive a first seed value using said first set of bits from said plurality of bits representing said first frame of said plurality speech frames; and a generator configured to generate a first random excitation value using said first seed value.

34. The speech coding device of claim 33, wherein said random excitation value is a fixed codebook excitation.

35. The speech coding device of claim 33, wherein said one frame of a plurality speech frames is a silence frame.

36. The speech coding device of claim 33, wherein said one frame of a plurality speech frames is a noise frame.

37. The speech coding device of claim 33, wherein said speech processing circuitry is further configured to obtain a second set of bits from a plurality of bits representing a second frame of said plurality speech frames, and derive a second seed value using said second set of bits from said plurality of bits representing said second frame of said plurality speech frames, and wherein said generator is further configured to generate a second random excitation value using said second seed value.

38. The speech coding device of claim 33, wherein said speech processing circuitry is further configured to obtain a set of bits from each frame of said plurality speech frames, and derive a seed value using said set of bits for each frame of said plurality speech flames, and wherein said generator is further configured to generate a second random excitation value using each said seed value.

39. The speech coding device of claim 33, wherein said speech processing circuitry and said generator are used by a decoder.

40. The speech coding device of claim 33, wherein said speech processing circuitry and said generator are used by an encoder.

41. The speech coding device of claim 33, wherein said first set of bits represent an energy.

42. The speech coding device of claim 33, wherein said first set of bits represent a spectrum.

* * * * *

UNITED STATES PATENT AND TRADEMARK OFFICE

CERTIFICATE OF CORRECTION

PATENT NO. : 7,146,309 B1
APPLICATION NO. : 10/653874
DATED : December 5, 2006
INVENTOR(S) : Benyassine et al.

It is certified that error appears in the above-identified patent and that said Letters Patent is hereby corrected as shown below:

Under the title, at col. 1, line 3, the specification should read: --The present application is a Divisional U.S. Application No. 09/617,191, now U.S. Patent No. 6,636,829, filed July 14, 2000, which claims priority to Provisional U.S. Application Serial No. 60/155,321, filed September 22, 1999.--

Signed and Sealed this

Ninth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,146,309 B1
APPLICATION NO. : 10/653874
DATED : December 5, 2006
INVENTOR(S) : Adil Benyassine et al.

It is certified that error appears in the above-identified patent and that said Letters Patent is hereby corrected as shown below:

This certificate vacates the Certificate of Correction issued March 9, 2010. Petition to accept unintentionally delayed claim for 35 U.S.C. 120; Benefit of a prior Application(s) under 37 CFR 1.78(a)(3)" was dismissed by the Office of Petitions. The Certificate of Correction should not have been issued for this patent number.

Signed and Sealed this

Thirtieth Day of November, 2010

David J. Kappos

David J. Kappos
*Director of the United States Patent and Trademark Office*